US006204796B1

(12) United States Patent
Chan et al.

(10) Patent No.: US 6,204,796 B1
(45) Date of Patent: Mar. 20, 2001

(54) APPARATUS AND METHODS FOR GENERATING CODES FOR CONTROLLING APPLIANCES FROM A REMOTE CONTROLLER

(75) Inventors: Philip W. Chan, Arcadia, CA (US); Yee Kong Ng; Kwong Sang Sin, both of Tai Po (HK)

(73) Assignee: Gemstar Development Corporation, Pasadena, CA (US)

( * ) Notice: Subject to any disclaimer, the term of this patent is extended or adjusted under 35 U.S.C. 154(b) by 0 days.

(21) Appl. No.: 09/036,852

(22) Filed: Mar. 9, 1998

Related U.S. Application Data

(63) Continuation of application No. 08/763,010, filed on Dec. 10, 1996, now abandoned, which is a continuation of application No. 08/269,847, filed on Jul. 1, 1994, now abandoned.

(51) Int. Cl.[7] ..... G08C 19/12

(52) U.S. Cl. ..... 341/176; 340/825.69; 348/734; 345/169; 379/102.03

(58) Field of Search ..... 341/176; 340/825.69, 340/825.72; 348/734; 345/169; 379/102.01, 102.03; 455/557

(56) References Cited

U.S. PATENT DOCUMENTS

| | | | |
|---|---|---|---|
| 4,356,509 | 10/1982 | Skerlos et al. | 358/85 |
| 4,363,091 | 12/1982 | Pohlman, III et al. | 364/200 |
| 4,386,412 | 5/1983 | Ito | 364/710 |
| 4,386,436 | 5/1983 | Kocher et al. | 455/151 |
| 4,488,179 | 12/1984 | Krüger | 358/181 |
| 4,503,288 | 3/1985 | Kessler | 179/2 |
| 4,509,211 | 4/1985 | Robbins | 455/603 |
| 4,517,564 | 5/1985 | Morishita et al. | 340/825.69 |
| 4,535,333 | 8/1985 | Twardowski | 340/825.69 |
| 4,566,034 | 1/1986 | Harger et al. | 358/194.1 |
| 4,580,009 | 4/1986 | Darland | 179/2 |
| 4,599,491 | 7/1986 | Serrano | 179/2 |
| 4,623,887 * | 11/1986 | Welles, II | 340/825.69 |

(List continued on next page.)

FOREIGN PATENT DOCUMENTS

| | | | |
|---|---|---|---|
| 2256546A | 12/1992 | (GB) . | |
| WO9007844 | 7/1990 | (WO) . | |
| WO9107050 | 5/1991 | (WO) . | |
| WO9401969 | 1/1994 | (WO) | H04N/5/44 |

OTHER PUBLICATIONS

Steve Ciarcia, Build a Trainable Infrared Master Controller, Mar. 1987 *BYTE* pp. 113–123.

Research Dislcosure, No. 329, Sep. 1991, Emsworth GB, p. 657, XP226205, 'Installation of Consumer Apparatuses'.

*Primary Examiner*—Michael Horabik
*Assistant Examiner*—Timothy Edwards, Jr.
(74) *Attorney, Agent, or Firm*—Christie, Parker & Hale, LLP

(57) ABSTRACT

Methods and apparatus are provided for generating codes for controlling appliances from a remote controller. One method includes the steps of entering a compressed pointer for accessing a stored protocol and for accessing stored key data corresponding to appliance command keys on the remote controller, decompressing the entered pointer, and storing the decompressed pointer, entering a compressed protocol for generating codes for controlling an appliance, the protocol comprising a pattern fragment for a zero and a one, a zero timing, a one timing, and a carrier frequency, decompressing the entered protocol, storing the decompressed protocol, entering compressed key data, the key data corresponding to appliance command keys on the remote controller, decompressing the entered key data, storing the decompressed key data, accessing the protocol and the key data using the pointer, and generating a code using the pattern fragment for a zero and a one, the zero timing, the one timing, the carrier frequency, and the key data.

15 Claims, 29 Drawing Sheets

U.S. PATENT DOCUMENTS

| | | | | |
|---|---|---|---|---|
| 4,625,080 | | 11/1986 | Scott | 379/104 |
| 4,626,848 | * | 12/1986 | Ehleis | 340/825.69 |
| 4,703,359 | | 10/1987 | Rumbolt et al. | 358/194.1 |
| 4,712,105 | | 12/1987 | Köhler et al. | 340/825.69 |
| 4,718,112 | | 1/1988 | Shinoda | 455/151 |
| 4,746,919 | | 5/1988 | Reitmeier | 340/825.56 |
| 4,751,578 | | 6/1988 | Reiter et al. . | |
| 4,769,643 | | 9/1988 | Sogame | 340/825.69 |
| 4,771,283 | * | 9/1988 | Imoto | 340/825.72 |
| 4,774,511 | | 9/1988 | Rumbolt et al. | 340/825.69 |
| 4,787,063 | | 11/1988 | Muguet . | |
| 4,794,371 | | 12/1988 | Yamamoto | 340/825.64 |
| 4,802,114 | | 1/1989 | Sogame | 364/900 |
| 4,807,052 | | 2/1989 | Amano | 358/194.1 |
| 4,825,200 | * | 4/1989 | Evans et al. | 341/176 |
| 4,841,368 | | 6/1989 | Rumbolt et al. | 358/194.1 |
| 4,855,746 | | 8/1989 | Stacy | 341/176 |
| 4,856,081 | * | 8/1989 | Smith | 340/825.69 |
| 4,860,380 | | 8/1989 | Mengel | 455/185 |
| 4,866,434 | * | 9/1989 | Keenan | 341/176 |
| 4,875,096 | | 10/1989 | Baer et al. | 358/143 |
| 4,885,766 | | 12/1989 | Yasuoka et al. | 379/105 |
| 4,918,439 | | 4/1990 | Wozniak et al. | 340/825.69 |
| 4,965,775 | | 10/1990 | Elko et al. | 367/119 |
| 5,016,273 | | 5/1991 | Hoff . | |
| 5,088,023 | | 2/1992 | Nakamura et al. | 395/425 |
| 5,134,649 | | 7/1992 | Gutzmer . | |
| 5,228,077 | * | 7/1993 | Darber | 379/102 |
| 5,307,173 | * | 4/1994 | Yuen et al. | 348/731 |
| 5,335,079 | * | 8/1994 | Yuen et al. | 358/335 |

* cited by examiner 1600
1602
1604
1554
1601
1605
1603
1605
1606
1552

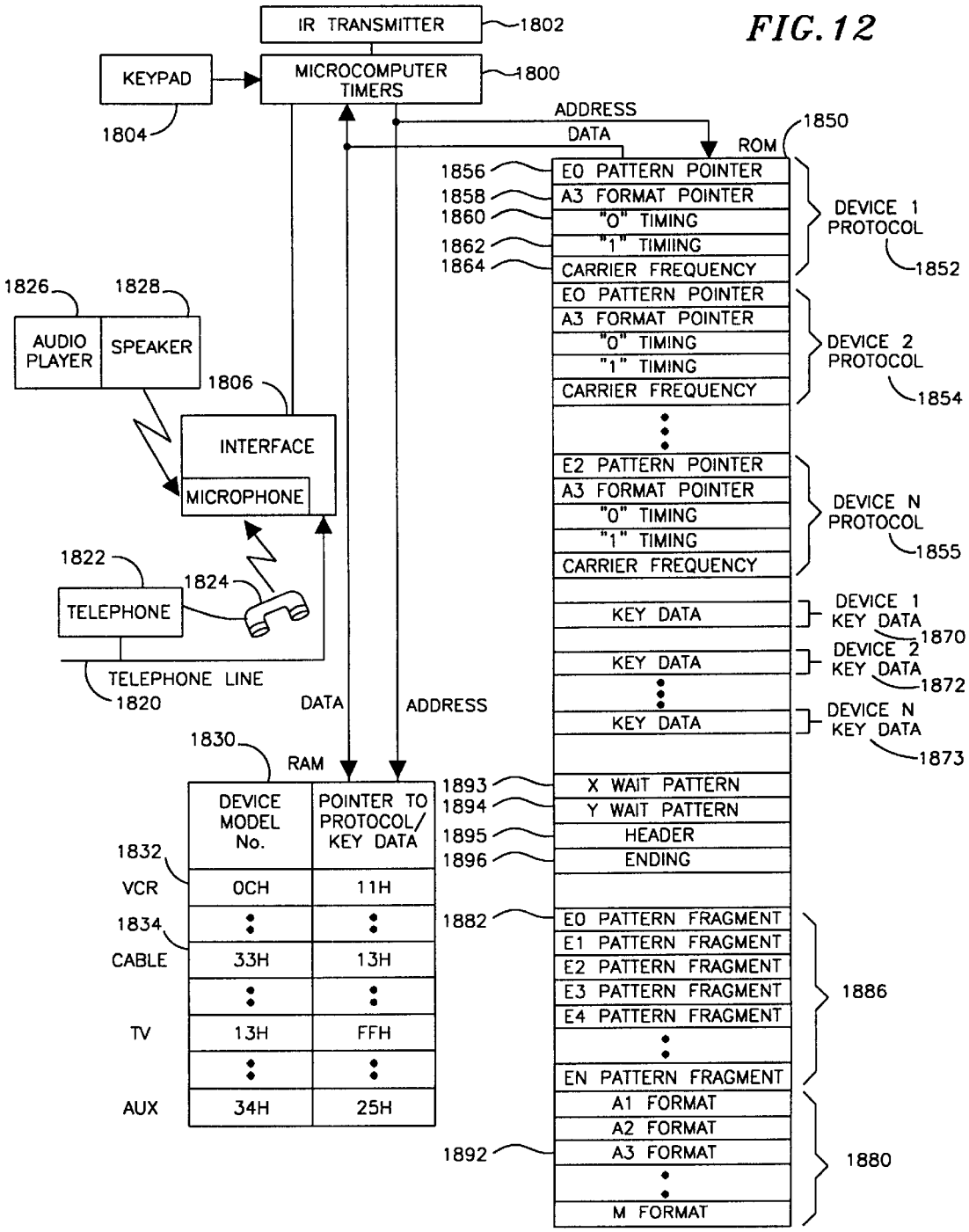
FIG. 12
IR TRANSMITTER
1802
KEYPAD
MICROCOMPUTER TIMERS
1800
1804
ADDRESS
DATA
ROM
1850
1856
E0 PATTERN POINTER
1858
A3 FORMAT POINTER
1860
"0" TIMING
1862
"1" TIMIING
1864
CARRIER FREQUENCY
DEVICE 1 PROTOCOL
1852
E0 PATTERN POINTER
A3 FORMAT POINTER
"0" TIMING
"1" TIMING
CARRIER FREQUENCY
DEVICE 2 PROTOCOL
1854
E2 PATTERN POINTER
A3 FORMAT POINTER
"0" TIMING
"1" TIMING
CARRIER FREQUENCY
DEVICE N PROTOCOL
1855
1826
1828
AUDIO PLAYER
SPEAKER
1806
INTERFACE
MICROPHONE
1822
1824
TELEPHONE
TELEPHONE LINE
1820
KEY DATA
DEVICE 1 KEY DATA
1870
KEY DATA
DEVICE 2 KEY DATA
1872
KEY DATA
DEVICE N KEY DATA
1873
DATA
ADDRESS
1830
RAM
DEVICE MODEL No.
POINTER TO PROTOCOL/ KEY DATA
1832
VCR
0CH
11H
1834
CABLE
33H
13H
TV
13H
FFH
AUX
34H
25H
1893
X WAIT PATTERN
1894
Y WAIT PATTERN
1895
HEADER
1896
ENDING
1882
E0 PATTERN FRAGMENT
E1 PATTERN FRAGMENT
E2 PATTERN FRAGMENT
E3 PATTERN FRAGMENT
E4 PATTERN FRAGMENT
EN PATTERN FRAGMENT
1886
1892
A1 FORMAT
A2 FORMAT
A3 FORMAT
M FORMAT
1880

*FIG. 13*

| | FRAGMENT NAME | | FRAGMENT NAME "0" BIT | FRAGMENT NAME "1" BIT |
|---|---|---|---|---|
| 2000 | E0 | INTER-BIT | 2010 | 2012 |
| 2002 | E1 | PULSE | 2014 | 2016 |
| | E2 | REVERSE INTER-BIT | | |
| | E3 | HIGH LOW | | |
| | E4 | SERIAL | | |
| | E5 | MISSING PULSE | | |

*FIG. 14*

| | FORMAT NAME | FORMAT | DESCRIPTION |
|---|---|---|---|
| 2030 | A1 | DX | DATA, WAIT 2032 |
| 2034 | A2 | ADX | ADDRESS, DATA, WAIT 2036 |
| | A3 | HDX | HEADER, DATA, WAIT |
| 2038 | A4 | HADX | HEADER, ADDRESS, DATA, WAIT 2040 |
| | A5 | D | DATA |
| | A6 | AD | ADDRESS, DATA |
| | A7 | HD | HEADER, DATA |
| | A8 | HAD | HEADER, ADDRESS, DATA |
| | • | • | • |
| | • | • | • |
| 2039 | A15 | HADADXEY | HEADER, ADDRESS, DATA, INVERSE ADDRESS, INVERSE DATA, WAIT, ENDING, WAIT |

KEY DATA

| KEY | KEY DATA |
|---|---|
| PAUSE | 0 0 1 0 1 0 |
| PLAY | 0 1 1 0 1 1 |
| VOLUME UP | 0 0 1 1 0 0 |
| VOLUME DOWN | 1 0 1 1 0 1 |
| ⋮ | ⋮ |

Fig. 26

DOWNLOAD FOR DEVICE A

| | | | | | | | | | | | | | |
|---|---|---|---|---|---|---|---|---|---|---|---|---|---|
| 0xf3 | 0x20 | 0x29 | 0x38 | 0x37 | 0x37 | 0x37 | 0x37 | 0xff | 0xff | | | | |
| 0xf3 | 0x00 | 0xff | 0xff | 0xff | 0xff | 0xff | 0xff | 0xff | 0xff | 0xff | 0xff | 0xff | 0xff |
| 0xf3 | 0x11 | 0x00 | 0x00 | 0x17 | 0x00 | 0xff | 0xff | 0xff | 0xff | 0xff | 0xff | 0xff | 0xff |
| 0xf3 | 0x20 | 0xff | 0xff | 0xff | 0xff | 0xff | 0xff | 0xff | 0xff | 0xff | 0xff | 0xff | 0xff |

2600

APPARATUS AND METHODS FOR GENERATING CODES FOR CONTROLLING APPLIANCES FROM A REMOTE CONTROLLER

CROSS-REFERENCE TO RELATED APPLICATIONS

This is a continuation of U.S. application Ser. No. 08/763,010 filed Dec. 10,1996, now abandoned, which is a continuation of U.S. application Ser. No. 08/269,847 filed Jul. 1, 1996, now abandoned. The subject matter of the above referenced applications are incorporated fully herein. This application is related to U.S. application Ser. Nos. 08/269,740, 08/031,246, 08/027,202, 08/000,934, 07/965,075, 07/877,687, 07/829,412, 07/767,323, 07/676,934, 07/371,054 and 07/289,369, which are incorporated fully herein.

BACKGROUND OF THE INVENTION

1. Field of the Invention

This invention relates to remote controllers of the type used to control VCRs, TVs, cable boxes and satellite receivers, and in particular relates to universal remote controllers that can control a variety of appliances.

2. Description of the Related Art

Universal remote controllers are available that provide the capability to mimic a number of different remote controllers. This allows the user to use one universal remote controller rather than have a separate remote controller for each appliance, such as one for a television and another one for the VCR and another one for the cable box. One conventional implementation of a universal remote controller includes a learn function key that is pushed to put the universal remote controller into the learn mode. While in the learn mode, the universal remote controller can learn the IR codes for each key on another remote controller, such as a remote controller for a VCR. The user pushes a key on the remote controller and a corresponding key on the universal remote controller and then the IR pulses that are transmitted from the remote controller are detected by an IR receiver on the universal remote controller and then are stored in the universal remote controller into a battery backed random access memory (RAM). This is repeated for all of the individual keys. Then when a key is pushed on a universal remote controller the IR code that has been learned from the other remote controller is retrieved from RAM and transmitted via an IR transmitter on the universal remote controller.

Another technique in the conventional art is to provide a programmer that can load the universal remote controller with the IR codes for various appliances.

For example, in the Darbee U.S. Pat. No. 5,228,077 there is disclosed a universal remote controller that can operate a variety of appliances. The Darbee universal remote controller includes a RAM which can store code data and instructions for generating codes for operating appliances. The instruction codes and code data are loaded into the RAM, which allows for infinite upgradability of the universal remote control. The code data in Darbee includes the on and off times for each IR code for the appliances to be controlled.

The Darbee patent discloses a data transmission system for coupling the universal remote controller through a modem to a telephone line, or through a television set to a television signal picked up by the television set. The data that is downloaded to the universal remote controller is the instruction code and the code data.

Another example of a universal remote controller is Ehlers, U.S. Pat. No. 4,626,848, which discloses a reconfigurable remote controller which has the ability to learn, store and repeat remote control codes from any other IR transmitter. Such a reconfigurable remote controller device includes an IR receiver, a microprocessor, a non-volatile random access memory, a scratch pad random access memory, and an IR transmitter. The Welles II, U.S. Pat. No. 4,623,887 is similar to the Ehlers patent. Another universal remote controller in the prior art is Evans, et al., U.S. Pat. No. 4,825,200, which teaches a reconfigurable remote control transmitter that includes a learn mode and a run mode and is similar to the remote control system disclosed in the Ehlers patent. Imoto, U.S. Pat. No. 4,771,283, teaches a system for collecting operating codes from various remote controllers by inputting the code data therefrom via IR code signals to an IR receiving diode at the input of the system, deciphering these code signals, storing them in a RAM and then upon operation of keys, supplying outputs via one of several cables extending to devices to be controlled.

In all of the previous universal remote controllers the entire IR code is essentially downloaded to the universal remote controller either via IR transmission or via telephone or via a television signal. Once the entire IR code, or data corresponding to the IR codes such as on and off times are stored in the universal remote controller RAM, then the user accesses this data by pressing keys on the universal remote controller, which sends commands to the appliances. If many appliances are to be controlled, the amount of the storage in the RAM can become excessive. Thus, it is desirable to provide a universal remote controller that does not need to store entire IR codes related to each individual key of each remote controller to be mimicked.

SUMMARY OF THE INVENTION

According to an embodiment of the invention, methods and apparatus are provided for generating codes for controlling appliances from a remote controller. One method includes the steps of entering a compressed pointer for accessing a stored protocol and for accessing stored key data corresponding to appliance command keys on the remote controller, decompressing the entered pointer, and storing the decompressed pointer. A compressed protocol for generating codes for controlling an appliance is entered, the protocol comprising a pattern fragment for a zero and a one, a zero timing, a one timing, and a carrier frequency. Then the steps of decompressing the entered protocol and storing the decompressed protocol are performed. Then compressed key data is entered, the key data corresponding to appliance command keys on the remote controller. The entered key data is decompressed and stored. Then the steps of accessing the protocol and the key data using the pointer, and generating a code using the pattern fragment for a zero and a one, the zero timing, the one timing, the carrier frequency, and the key data are performed.

Many of the attendant features of this invention will be more readily appreciated as the same becomes better understood by reference to the following detailed descriptions and considered in connection with the accompanying drawings in which like reference symbols designate like parts throughout the figures.

BRIEF DESCRIPTION OF THE DRAWINGS

FIG. 4*b* shows the apparatus of FIG. 4*a* being used in conjunction with a telephone according to an embodiment of the invention;

FIG. 12 is a schematic showing pointers to protocols and key data stored in a RAM and protocols, key data, pattern fragments, and formats stored in a ROM according to an embodiment of the invention;

FIG. 13 shows a set of pattern fragments according to an embodiment of the invention;

FIG. 14 shows a set of formats according to an embodiment of the invention;

FIG. 26 is an example of data downloaded to a remote controller for a device to be controlled, according to an embodiment of the invention.

DETAILED DESCRIPTION

Figure 1:
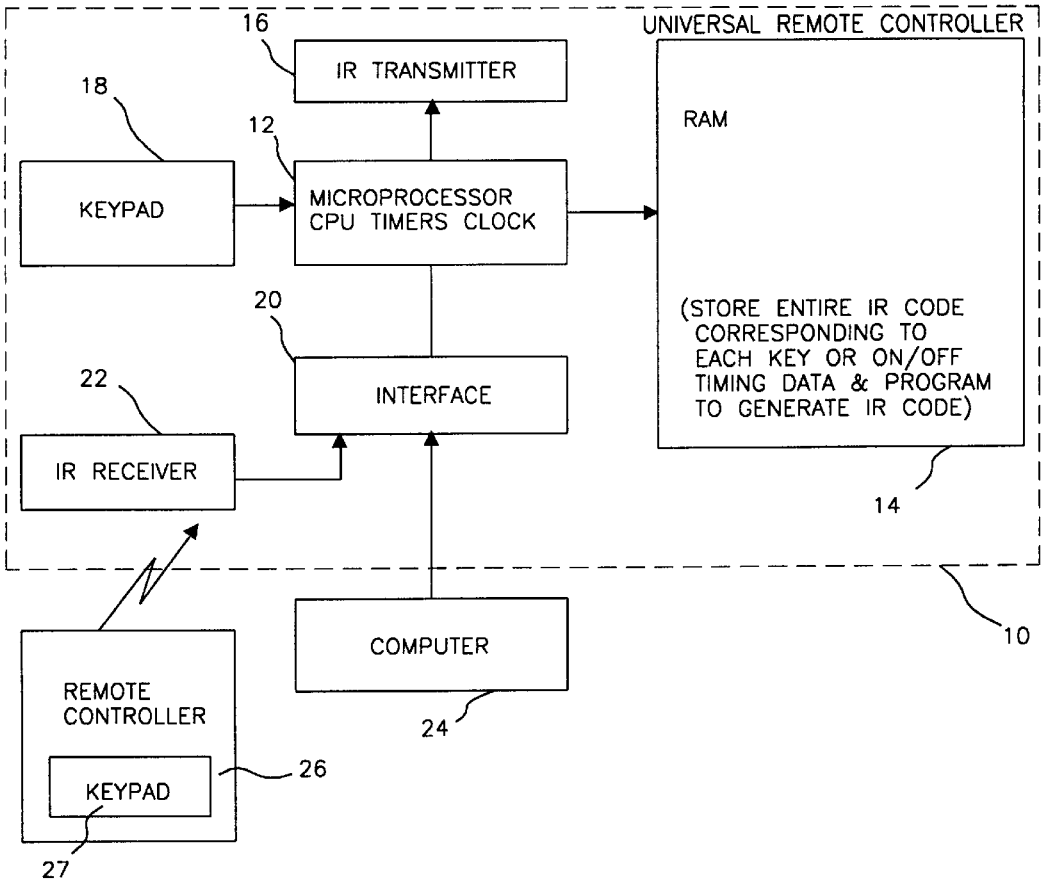
FIG. 1 PRIOR ART
FIG. 1 is a schematic of a universal remote controller.

Referring now to the drawings, and more particularly, to FIG. 1, there is shown a schematic of a conventional universal remote controller, which contains a microprocessor 12, a random access memory (RAM) 14, an IR transmitter 16 and a keypad 18. These elements are the normal elements of a conventional remote controller that is not a universal remote controller. A universal remote controller normally has an interface 20, through which it is possible to enter IR codes for various appliances into the universal remote controller 10. In one implementation the universal remote controller 10 learns the IR codes for remote controller 26 via IR codes sent from the remote controller 26 when a user presses a key on keypad 27. The transmitted IR codes are received by IR receiver 22 in the universal remote controller and sent via interface 20 and microprocessor 12 for storage in RAM 14. This is the technique employed in the Ehlers patent referred to above in the Background of the Invention. Another technique is to load IR codes into RAM 14 from a computer 24 via the interface 20.

Figure 2:
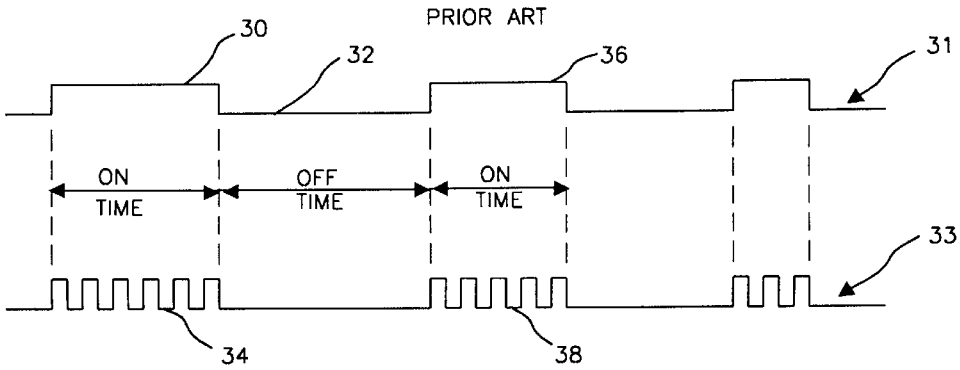
FIG. 2 PRIOR ART
FIG. 2 is a timing diagram showing an IR bit stream that is learned and generated by a universal remote controller.

FIG. 2. shows the timing of a IR bit stream for an IR code. During the ON times 30 and 36, the carrier frequency is transmitted as shown in FIG. 2 elements 34 and 38. During the OFF times there is no transmission of the carrier frequency. One technique for storing the IR code is to store the time line 31 which reduces the amount of storage as opposed to storing the IR bit stream 33 which includes the carrier frequency. This is the technique employed in the Darbee patent referred to above in the Background of the Invention. In Darbee the carrier is filtered to construct the time line 31 which is then stored in the RAM 14. Another technique is to store a sequence of ON times and OFF times. For example, the length of the ON time 30 would be stored followed by the length of the OFF time 32 followed by the length of the ON time 36 and so on. Once these ON and OFF times are stored, then the universal remote controller can be used to send commands corresponding to a key. Each key on keypad 27 generates a corresponding IR bit stream 33. Thus, in the implementation of the universal remote controller as illustrated in FIGS. 1 and 2, a unique ON/OFF time pattern will be stored for each key on the remote controller being mimicked by the universal remote controller.

Figure 3:
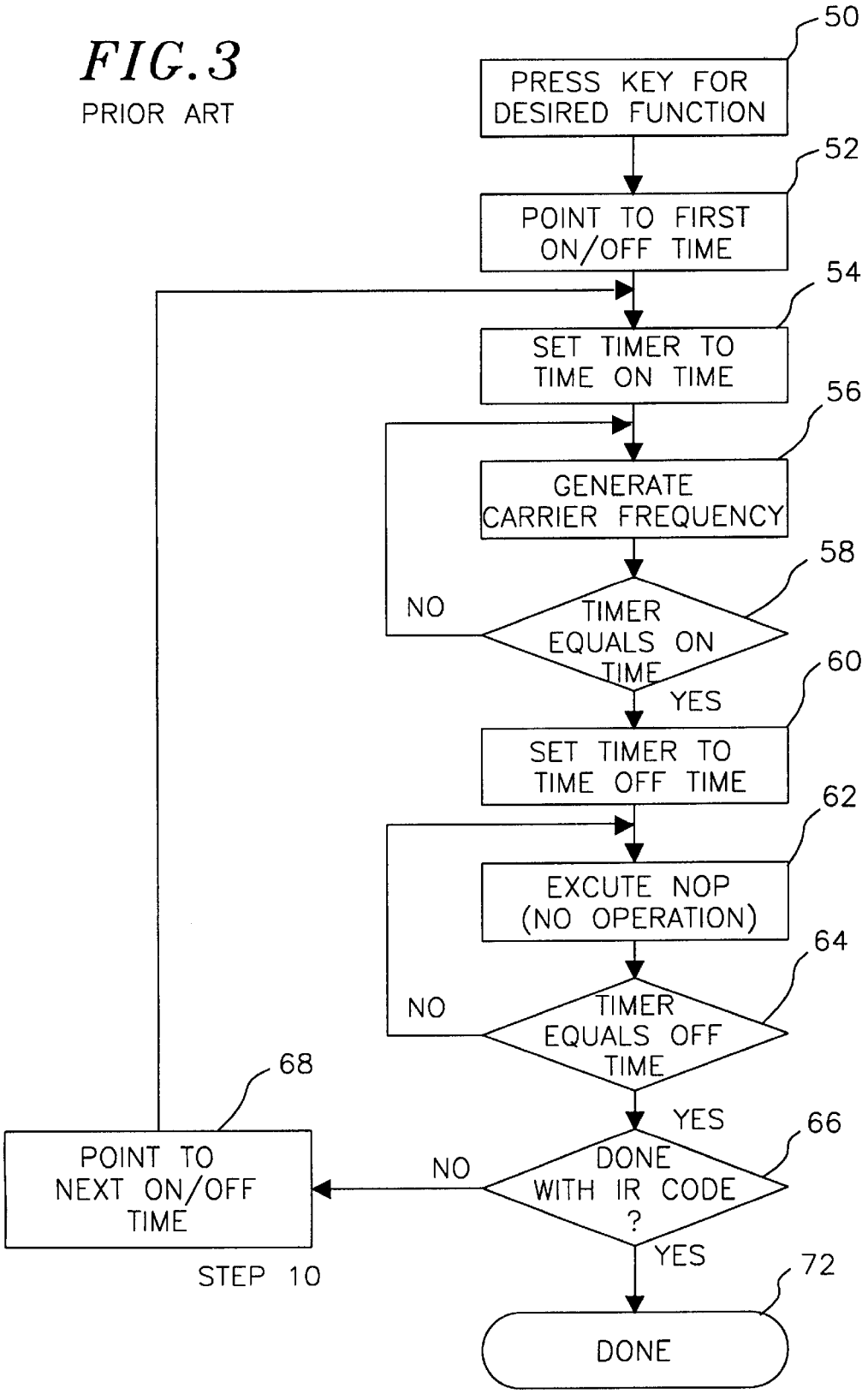
FIG. 3 PRIOR ART
FIG. 3 is a flow diagram of a method for generating IR codes in a universal remote controller.

For the technique that stores a sequence of ON and OFF times for each key, FIG. 3 shows a flow diagram of a method for generating the IR bit stream corresponding to a pressed key. In step 50 a key is pressed for the desired function. Then in step 52 the microprocessor will access the first ON or OFF time from the sequence of ON/OFF times that correspond to the key. Then in step 54 a timer is set to time the ON time and in step 56 a carrier frequency is generated. Then in step 58 when a timer equals the ON time the generation of the carrier frequency is terminated and a timer is set to time the OFF time in step 60. Then in steps 62 and 64 NOPs (no operations) are executed until the time equals the OFF time. In step 56 it is determined whether the IR code is complete. If the IR code is not complete, then in step 68 the microprocessor accesses the next ON/OFF time from the RAM 14 and steps 54 through 66 are repeated. Finally, the complete IR code will be generated and transmitted and in step 72 the operation is completed.

As discussed above, a disadvantage with this technique is that an entire sequence of ON/OFF times must be stored for each of the keys. The following describes apparatus and methods for generating IR codes for controlling appliances from a remote controller, which avoids the shortcomings of the conventional universal remote controllers.

Figure 4A:
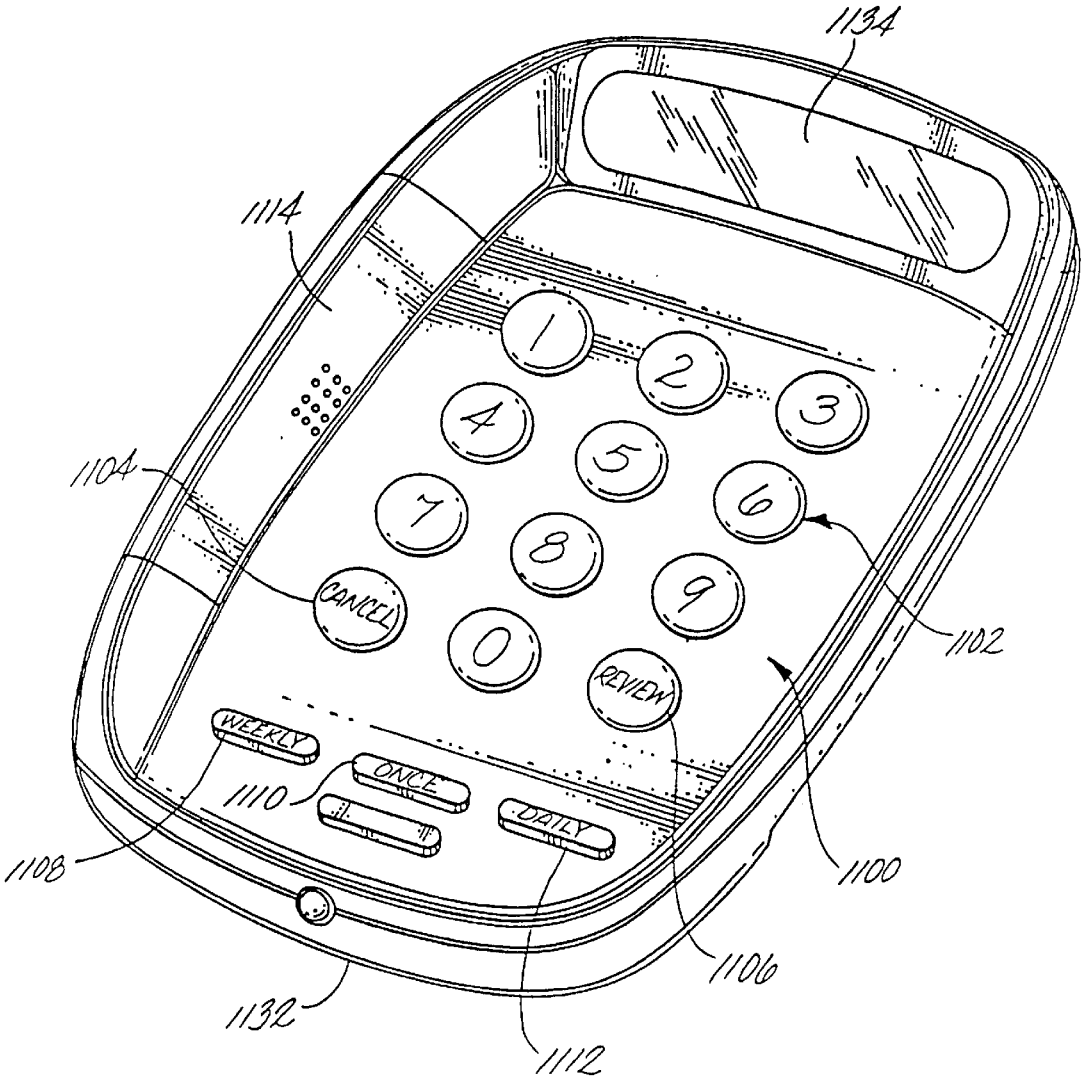
FIG. 4*a* is a perspective view of an apparatus for using compressed codes for recorder preprogramming according to an embodiment of the invention.
Figure 46:
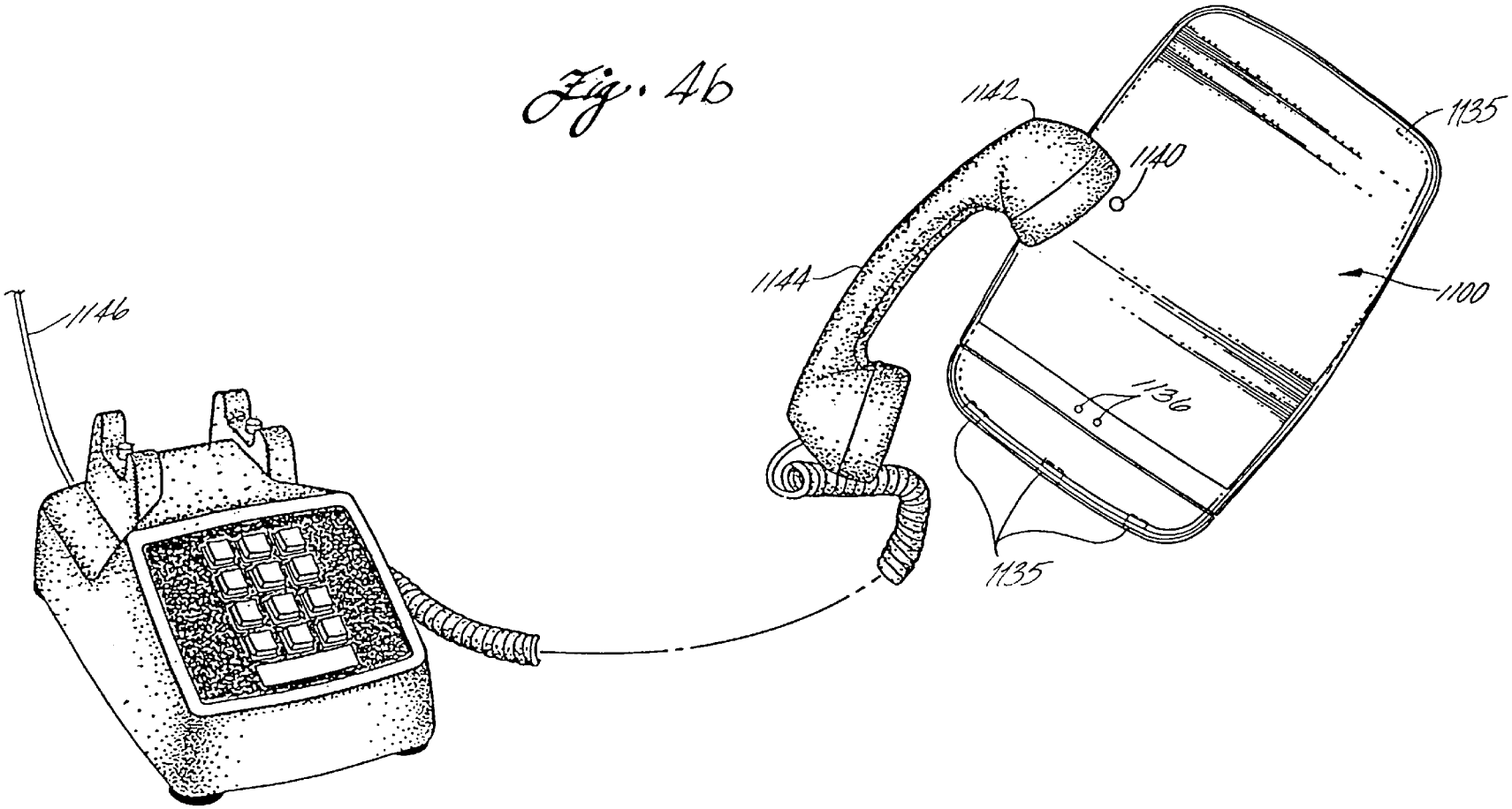

An embodiment of an apparatus for using compressed codes for recorder programming is the custom programmer 1100 of FIG. 4*a*.

The purpose of the custom programmer is to significantly reduce the number of keystrokes required to set up the timer preprogramming feature on a VCR. It is only necessary for the user to enter a code with 1 to 8 digits or more into the VCR. This can be done either remotely or locally at the VCR. Built into either the custom programmer is a decoder which automatically converts the code into the proper channel, day, time-of-day, and length (CDTL) programming information and activates the VCR to record a given television program with the corresponding channel, date, time and length. Generally multiple codes can be entered at one time for multiple program selections. The code can be printed in a television program guide in advance and selected for use with a VCR or remote controller with the decoding means.

A product embodying these features is now commercially available and has enjoyed great commercial success. This instant programmer, sold under the VCRPlus+® trademark, consists of a hand-held unit into which compressed codes (each 1 to 8 digits long) for television programs to be recorded are entered. The compressed codes are most commonly found in printed television listings. The instant programmer decodes the compressed codes into channel, date, time-of-day and length commands which are then stored in the programmer's memory. When date and time of the program in the memory that is scheduled the nearest to the current time coincides with the current time, as determined by an internal clock, the instant programmer, using an IR transmitter and universal remote technology, sends IR remote control signals to a cable box or a video recorder to change the channel to the correct channel and IR remote control signals to a video recorder to turn the recorder on and begin recording. After the length for the program, stored in memory, has elapsed, an IR remote control signal to stop recording is sent to the video recorder.

The custom programmer 1100 has number keys 1102, which are numbered 0–9, a CANCEL key 1104, a REVIEW key 1106, a WEEKLY key 1108, a ONCE key 1110 and a DAILY (M–F) key 1112, which are used to program the custom programmer 1100. A lid normally covers other keys, which are used to setup the custom programmer 1100. When lid 1114 is lifted, the following keys are revealed, but not shown in the drawings: SAVE key, ENTER key, CLOCK key, CH key, ADD TIME key, VCR key, CABLE key, and TEST key. Also included in the custom programmer 1100 as shown in FIG. 4*a* are the liquid crystal display 1134 and the red warning light emitting diode 1132, and as shown in FIG. 4*b* are IR diodes 1135 and access holes 1136. The two access holes 1136 in the bottom of the custom programmer 1100 are for receiving two contact pins, thereby allowing access to two contact points on the circuit board (not shown) inside the custom programmer 1100.

When using the custom programmer 1100, the consumer initially performs a set-up sequence, consisting of selecting a protocol for the model/brand of VCR, setting the current real time, selecting a protocol for the model/brand of cable box, and entering a series of channel number assignments. This initial set-up sequence for the custom programmer 1100 is somewhat complex and may deter the use of the custom programmer by some consumers.

To relieve the complexity of manually performing initial set-up for the custom programmer, custom programmer 1100 includes a microphone opening 1140 through which a microphone inside the custom programmer 1100 can receive electronically coded audio signals that contain the information necessary for the custom programmer's initial set-up and commands to store this information into the custom programmer 1100.

In order to receive these audio signals, a user may call a special phone number which could be a toll-free 800 number, a pay-per-minute 900 number, or a standard telephone number with standard toll charges applying. The consumer can speak to an operator who orally inquires from the consumer the information regarding the consumer's VCR model and brand, zip code, model and brand of cable box and the newspaper or other publication which the consumer will use to obtain the compressed codes. This is all the information needed to perform the initial set-up for the custom programmer 1100. From the zip code information, the operator can determine to which cable system the consumer is connected and can combine this data with the knowledge of which publication the consumer will use to select the correct local channel mapping table for the consumer.

The operator then directs the consumer to press a designated programming key which is, in the case of the preferred embodiment, the CH key located under lid 1114. When the CH key is pressed, the display 1134 with display the message "PHONE1 KEY2. Pressing the "2" numeric key places the custom programmer into the manual set-up mode. Pressing the "1" numeric key initiates the remote programming mode. The custom programmer 1100 is then ready to receive an audio signal and display 1134 displays the message "WAIT".

The operator will then direct the consumer to place the earpiece 1142 of the telephone receiver 1144 over the microphone opening 1140 of the custom programmer 1100 as generally shown in FIG. 4*b*. The earpiece need not be placed directly against the custom programmer 1100, but may be held more than an inch away from the microphone opening with generally satisfactory results. After a pause sufficient to allow the consumer to place the telephone receiver in the proper position, the operator will initiate the downloading of the initial set-up data and initial set-up programming commands transmitted over the telephone line 1146 using audio signals to the consumer's custom programmer 1100.

If the initial set-up data is successfully transferred to the custom programmer 1100, the display 1134 of the custom programmer 1100 will display the message "DONE". If the reception of the initial set-up data is not successful within a predetermined time limit, red warning light emitting diode 1132 will blink to inform the consumer to adjust the position of the telephone earpiece before another down load of the information is attempted. After a waiting period allowing this adjustment, the initial set-up data and commands are re-transmitted over the telephone line. If after a predetermined number of attempts to download the initial set-up information are unsuccessful, the liquid crystal display 1134 displays the message "FAIL" and the operator is again connected to the consumer allowing the operator to speak to the consumer to provide additional assistance in the positioning of the telephone earpiece.

Alternatively, a live operator could be provided by the local cable company and the initial set-up information downloaded to the custom programmer 1100 by telephone line, through the existing cable of the cable system, or any other transmission means. If local cable companies supply the live operators, the only information they would need to gather from the consumer would be the VCR brand and model and the publication containing compressed codes that the consumer plans on using, because the local cable company would know the model and brand of cable box installed at the consumer's location and the necessary data regarding the local channel designations for that cable system.

Figure 5:
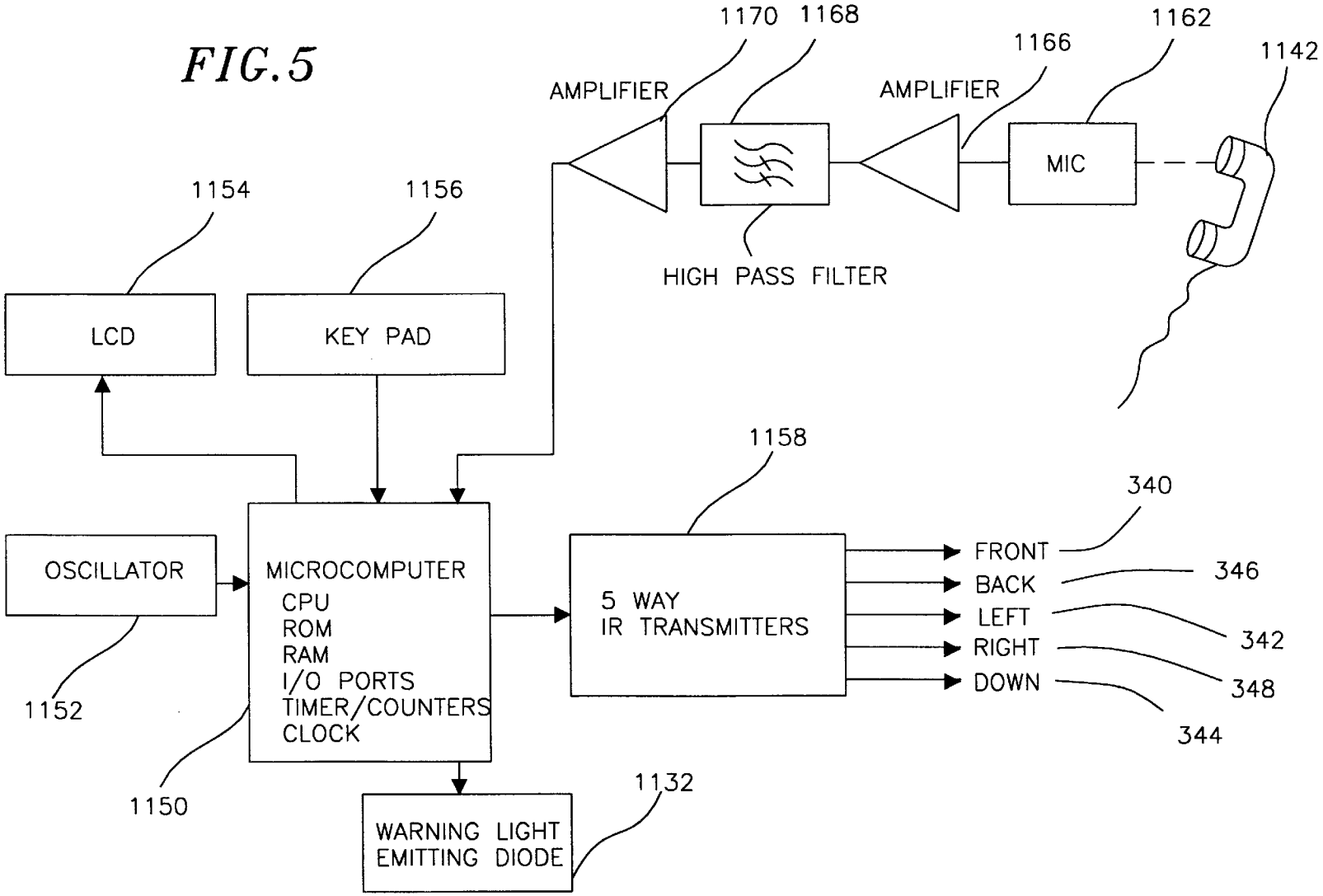
FIG. 5 is a schematic showing apparatus including circuitry for downloading information via a telephone and for using compressed codes for recorder preprogramming according to an embodiment of the invention.

FIG. 5 is a schematic of the circuitry needed to implement alternative embodiments of the custom programmer 1100. The circuit consists of microcomputer 1150, oscillator 1152, liquid crystal display 1154, keypad 1156, five way IR transmitters 1158 and red warning light emitting diode 1132. In FIG. 5, earpiece 1142 generates audio signals which are received by microphone 1162. As shown, the audio signals received by microphone 1162 are passed through amplifier 1166, through a band pass filter 1168 with a cutoff at approximately 1–4 kHz, and through a second amplifier 1170 to a serial port of microcomputer 1150.

Figure 6:
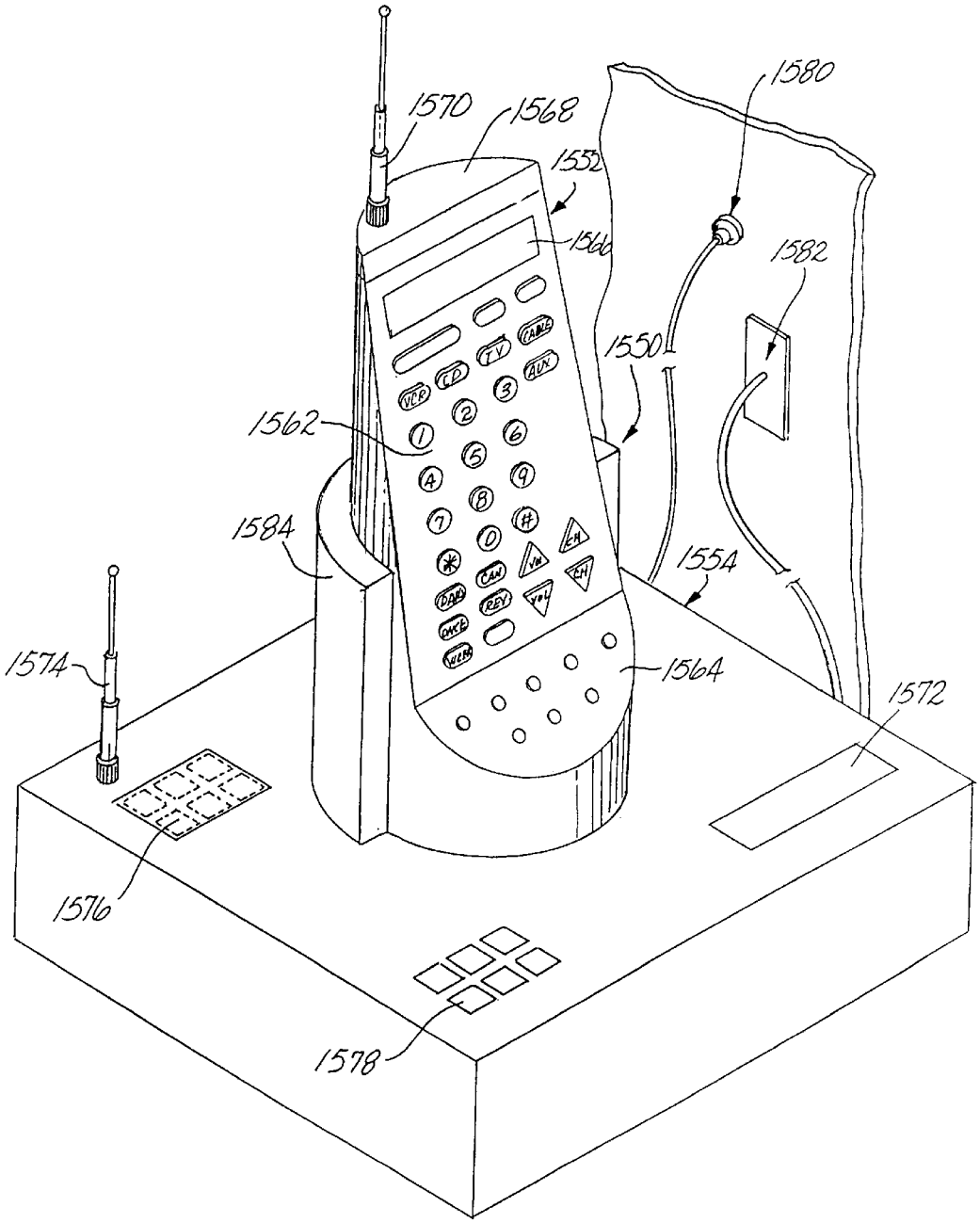
FIG. 6 is a perspective view of a telephone set having a decoder for decoding compressed codes for recorder programming and showing a cordless telephone including an universal remote controller mounted in a telephone base unit according to an embodiment of the invention.

In the embodiment shown in FIG. 6, the functional elements of the custom programmer 1100 are embedded within a telephone set 1550. The telephone set can perform all of the compressed code decoding and VCR programming functions of the custom programmer. In addition the telephone set can operate as an universal remote controller for controlling appliances such as televisions, cable boxes, VCRs and satellite receivers.

In the embodiment shown in FIG. 6, no microphone 1140, as shown in FIG. 4*b*, for downloading information from a telephone receiver is required, because the telephone set 1550 is connected directly to the telephone network, as shown by telephone connection 1582. The telephone connection is to a telephone network, and the connection can be via telephone lines or via a cellular network. In the embodiment shown in FIG. 6, the telephone set comprises a telephone base unit 1554 into which a cordless telephone 1552 is inserted. The telephone base unit can hold the cordless telephone and also charge the batteries of the cordless telephone. A telephone set that does not include a cordless telephone is another embodiment that is not shown, but such a telephone set operates very similarly to the description that follows for the telephone base unit except there would not be a cordless telephone or an RF link to the cordless telephone.

The cordless telephone 1552 includes controls 1562 and controls 1564 which provide the controls of custom programmer 1100 and also the controls required for a universal remote controller, such as channel and volume up and down keys and VCR, CD, TV, CABLE and AUX select buttons. The cordless telephone also includes a display 1566 corresponding to display 1134 of custom programmer 1100. An antenna 1570 is included on the cordless telephone to provide a RF link to the telephone base unit. An IR transparent cover 1568 covers an IR transmitter and in one embodiment also an IR receiver.

The telephone base unit 1554 includes controls 1578 and 1576 which correspond to the controls 1562 and 1564 on the cordless telephone. The telephone base unit also includes antenna 1574 for providing an RF link to the cordless telephone 1552. The telephone base unit can also contain a display 1572 corresponding to display 1566 on the cordless telephone. The telephone base unit can have a direct wall power connection 1580 and be connected directly to the telephone line via connection 1582. Alternatively, the connection to the telephone network can be via a cellular network. Various designs of the telephone base unit and the cordless telephone are possible. FIG. 6 shows one possible design in which the telephone base unit 1554 has a semicircular tower 1584 that is designed to hold the cordless telephone 1552. The tower 1584 also has the function of providing an elevated tower for holding IR transmitters and an IR receiver.

IR transmitters can be located around the top of the tower pointing in an upward direction, a right direction, a left direction, a rear direction and a forward direction. The multiple IR transmitters insure that the telephone base unit will communicate properly with the appliances to be controlled regardless of the orientation of the telephone unit with respect to those units. IR receivers can be placed at the top of the tower 1584 for receiving information from the appliances.

In this application the term appliances and the term devices include televisions, cable boxes, satellite receivers, VCRs, stereos and other similar equipment, including any remote controller for the various apparatus. The terms also include other apparatus such as heaters, thermostats, washing machines, ovens, lights, and computers.

Figure 7:
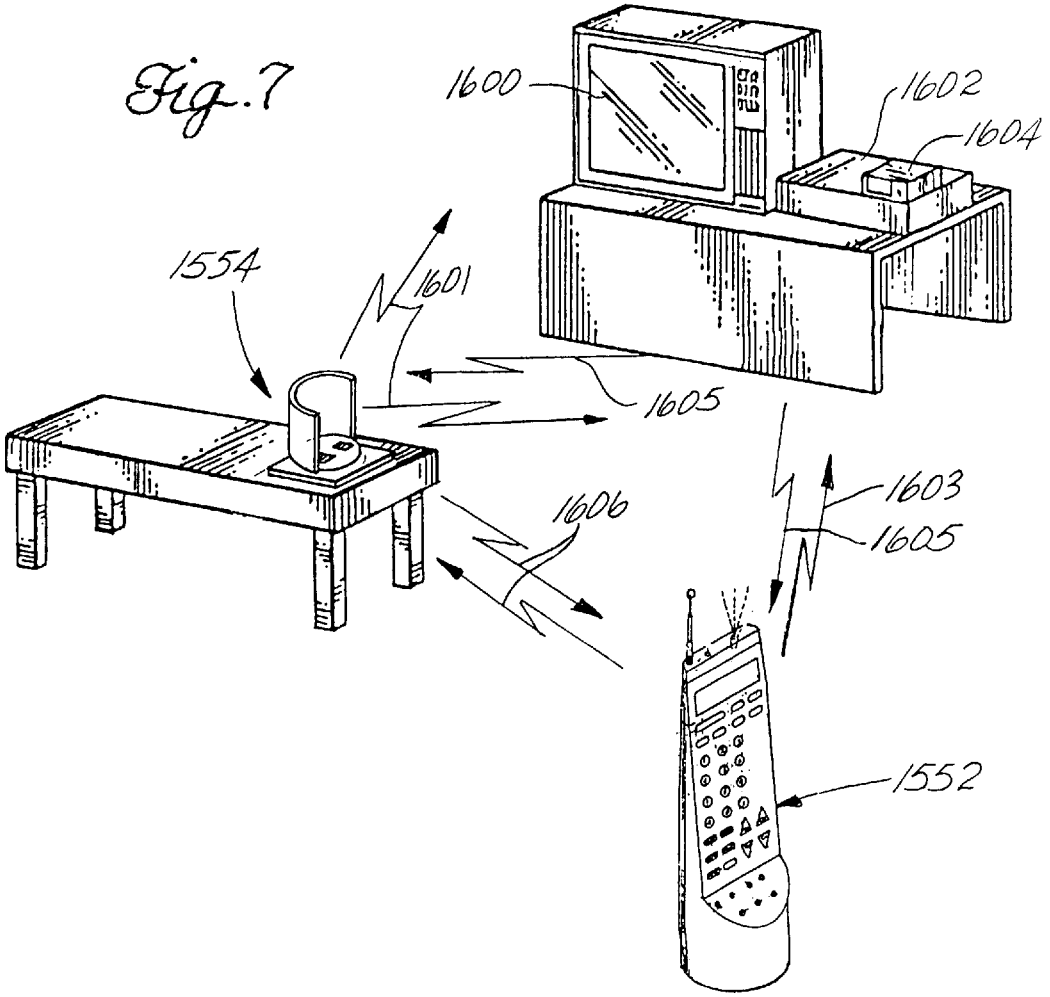
FIG. 7 is a perspective view showing a manner of placing the telephone base unit of FIG. 6 relative to a video cassette recorder, cable box and television set according to an embodiment of the invention.

FIG. 7 shows the telephone base unit 1554 located on a table near a video cassette recorder 1602, a cable box 1604 and a television 1600. The cordless telephone 1552, which can be in the same room as the telephone base unit or be in a different room, communicates with the telephone base unit via RF signals 1606. The telephone base unit controls the VCR, cable box, and television set via IR signals 1601. The cordless telephone, if it is in the same room as the appliances, can also control the appliances via transmission signals 1603, which can be IR signals, or RF signals if the appliances contain an RF receiver.

Television signals can contain embedded information which can be extracted by the VCR and transmitted to the telephone base unit or to the cordless telephone via transmission signals 1605, which can be IR signals, or RF signals if the appliances contain an RF transmitter.

Figure 8:
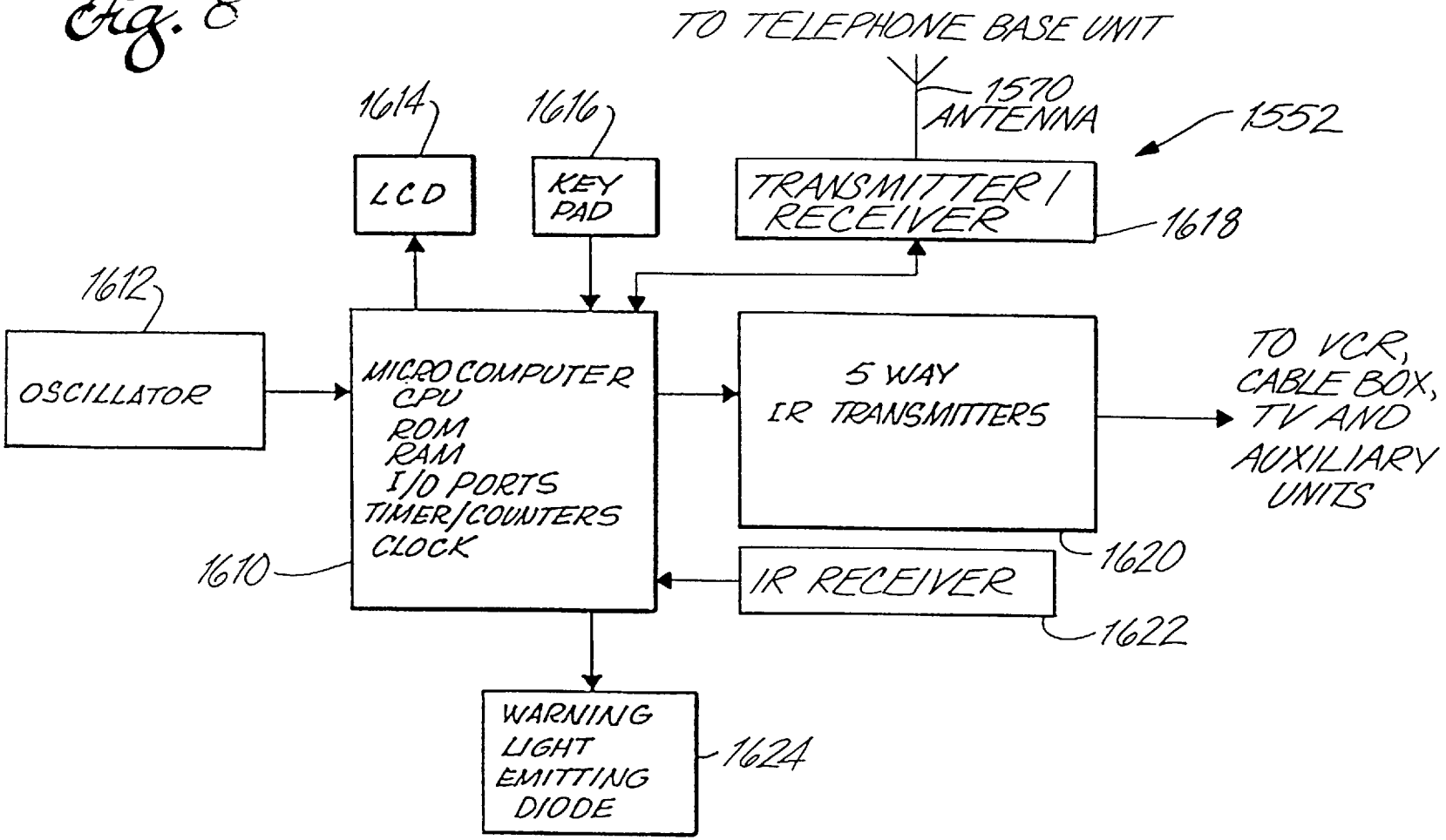
FIG. 8 is a schematic of a cordless telephone including a universal remote controller and having an embedded code decoder means according to an embodiment of the invention.

FIG. 8 is a block diagram of the cordless telephone. The cordless telephone has a microcomputer 1610, which consists of a CPU, ROM, RAM, I/O ports, timers and counters, and a clock. The microcomputer is used to implement the decoding of compressed codes having at least one digit into channel, time-of-day and length commands. Programs stored in the memory of the microcomputer also are instrumental in implementing the other functions of the cordless telephone including the functions of an universal remote controller. The microcomputer has an input from an oscillator 1612 and inputs from the keypad 1616 on the cordless telephone. The microcomputer drives a LCD display 1614 and also drives a warning light-emitting diode 1624. Communications to the telephone base unit are via transmitter/receiver 1618 and antenna 1570. The cordless telephone can send commands to appliances through the IR transmitter 1620 or the RF transmitter 1618 and can receive information from the appliances via IR receiver 1622 or the RF receiver 1618. A battery provides power to the cordless telephone and can be charged from the telephone base unit.

Figure 9:
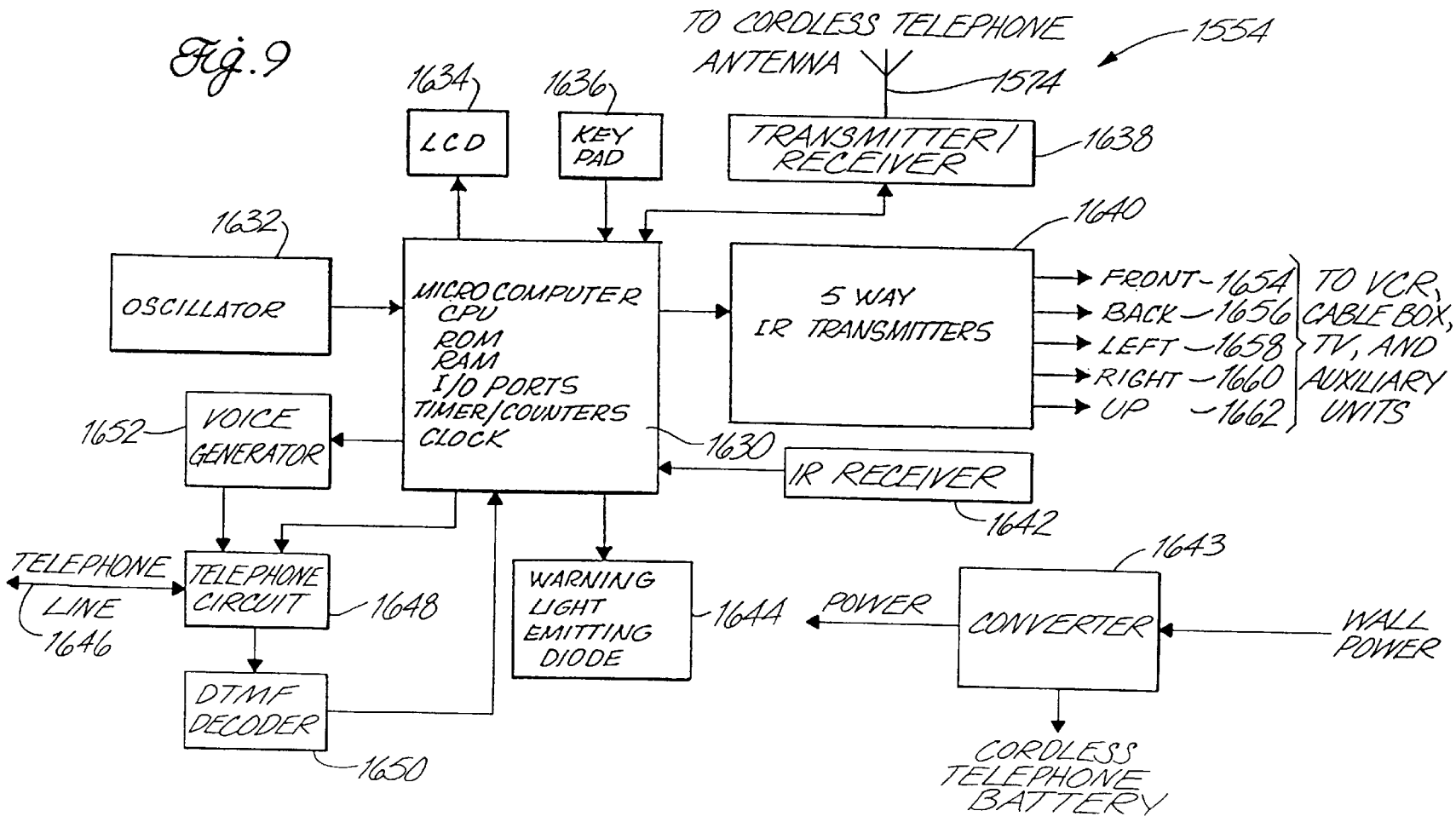
FIG. 9 is a schematic of a telephone set including a universal remote controller and having an embedded code decoder means according to an embodiment of the invention.

FIG. 9 shows a block diagram of the telephone base unit 1554. The telephone base unit has a microcomputer 1630 which contains a CPU, ROM, RAM, I/O ports, timers and counters, and a clock. The microcomputer is used to implement the decoding of compressed codes having at least one digit into channel, time-of-day and length commands. Programs stored in the memory of the microcomputer also are instrumental in implementing the other functions of the telephone base unit. The microcomputer has input from an oscillator 1632 and from a keypad 1636 on the face of the telephone base unit. The microcomputer drives a LCD display 1634 on the telephone base unit and also drives a warning light-emitting diode 1644. Communication with the cordless telephone is via transmitter/receiver 1638 and antenna 1574. The telephone base unit can send commands to the appliances via five-way IR transmitter 1640, which can transmit to the front, the back, left, right and up to insure communication with the appliances, or via RF transmitter 1638. Information from the appliances can be received by the telephone base unit via IR receiver 1642 or via RF receiver 1638. The telephone base unit contains a converter 1643 for providing power from wall power to the telephone base unit and for charging the cordless telephone battery. The telephone base unit has a direct connection with telephone line 1646 via telephone circuit 1648 which communicates to a DTMF decoder 1650 for input to the microcomputer 1630. As discussed above, instead of connection to a telephone line the telephone base unit could be connected to the telephone network via a cellular network. The microcomputer 1630 can communicate to the telephone circuit 1648 either directly or via voice generator 1652. The voice generator can synthesize speech for requesting a user to enter certain numbers, such as a password or a telephone number.

The telephone base unit and cordless telephone perform all of the functions of the custom programmer 1100 and the functions of a universal remote controller. Compressed code decoding for codes compressed from channel, day, time-of-day, and length, is performed by the microcomputers in either the telephone base unit or the cordless telephone and, at the appropriate time, record-on commands are sent to the VCR 1602, and channel-select commands are sent to the cable box 1604, a satellite receiver, and/or the TV 1600. Then, when recording is complete according to the decoded length from the CDTL information for a program to be recorded, the VCR 1602 is commanded to stop recording. The warning light-emitting diode 1624 in the cordless telephone and the warning light-emitting diode 1644 in the telephone base unit have the same function, which is to warn the user that a program is about to be recorded so that a tape is loaded into the VCR, as the warning light 1132 of custom programmer 1100.

Commands can also be sent to a television set based on decoded CDTL information, to turn on a television and switch to the correct channel at the appropriate time for a program, and then turn off the television when the program is over. This is especially useful for handicapped people.

Figure 10:
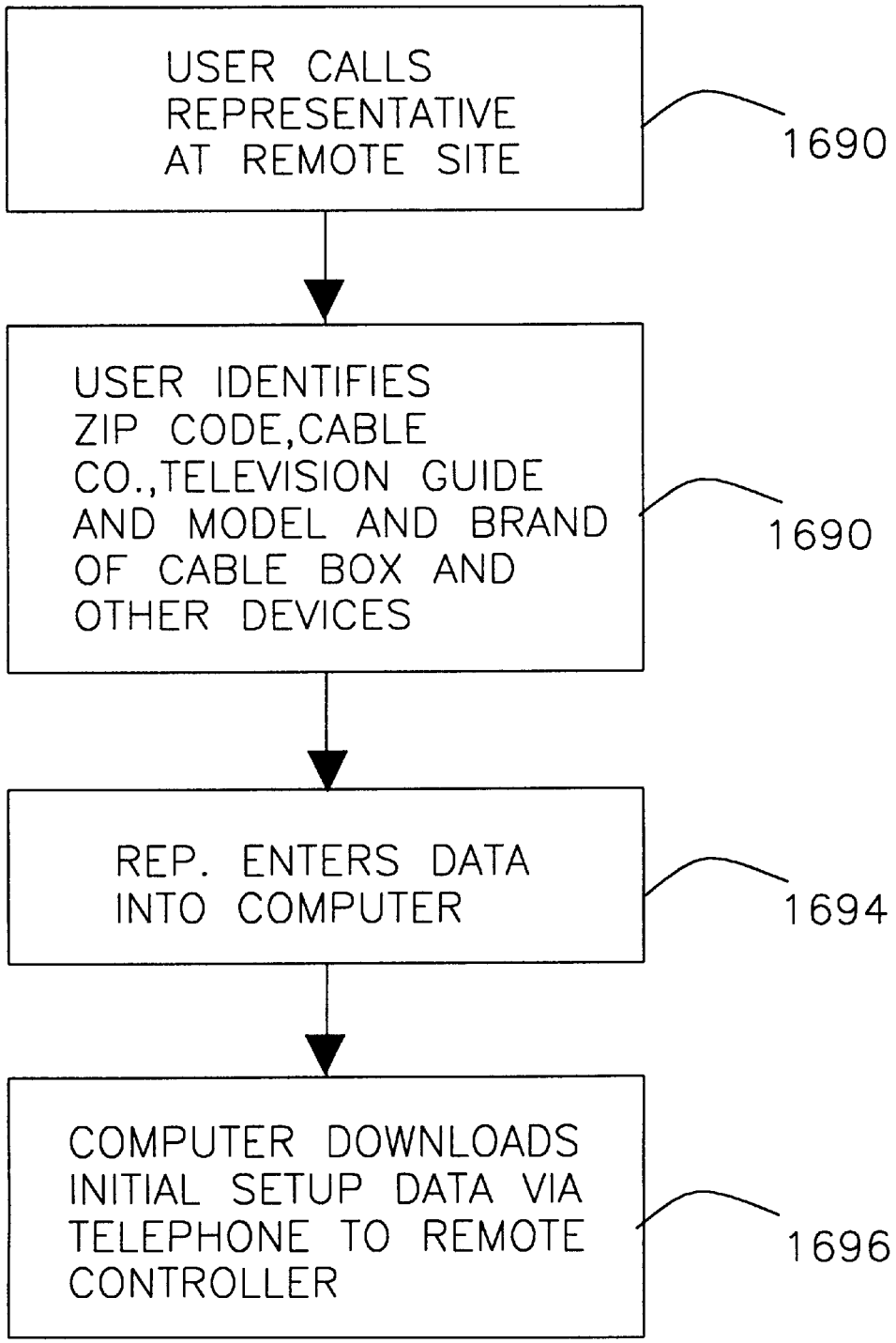
FIG. 10 is a flow diagram of a method for downloading initial setup data from a remote site to a universal remote controller according to an embodiment of the invention.

FIG. 10 is a flow diagram of a method for downloading initial setup data to the telephone base unit via the telephone network. The method is also applicable for the custom programmer 1100, and makes the initial set-up much easier. In step 1690, the user calls a representative at a remote site. Then in step 1692, the user identifies his zip code, the cable carrier, the television guide used by the user, and the model and brand of the VCR, cable box and any other appliances to be controlled, such as a satellite receiver. In step 1694, the representative enters this data into a computer, and then in step 1696, the computer downloads initial setup data via telephone to the telephone base unit or custom programmer. Then the telephone base unit via the RF antenna sends initial setup data to the cordless telephone. In general, the download method can be used with an universal remote controller.

Download Format

Figure 11:
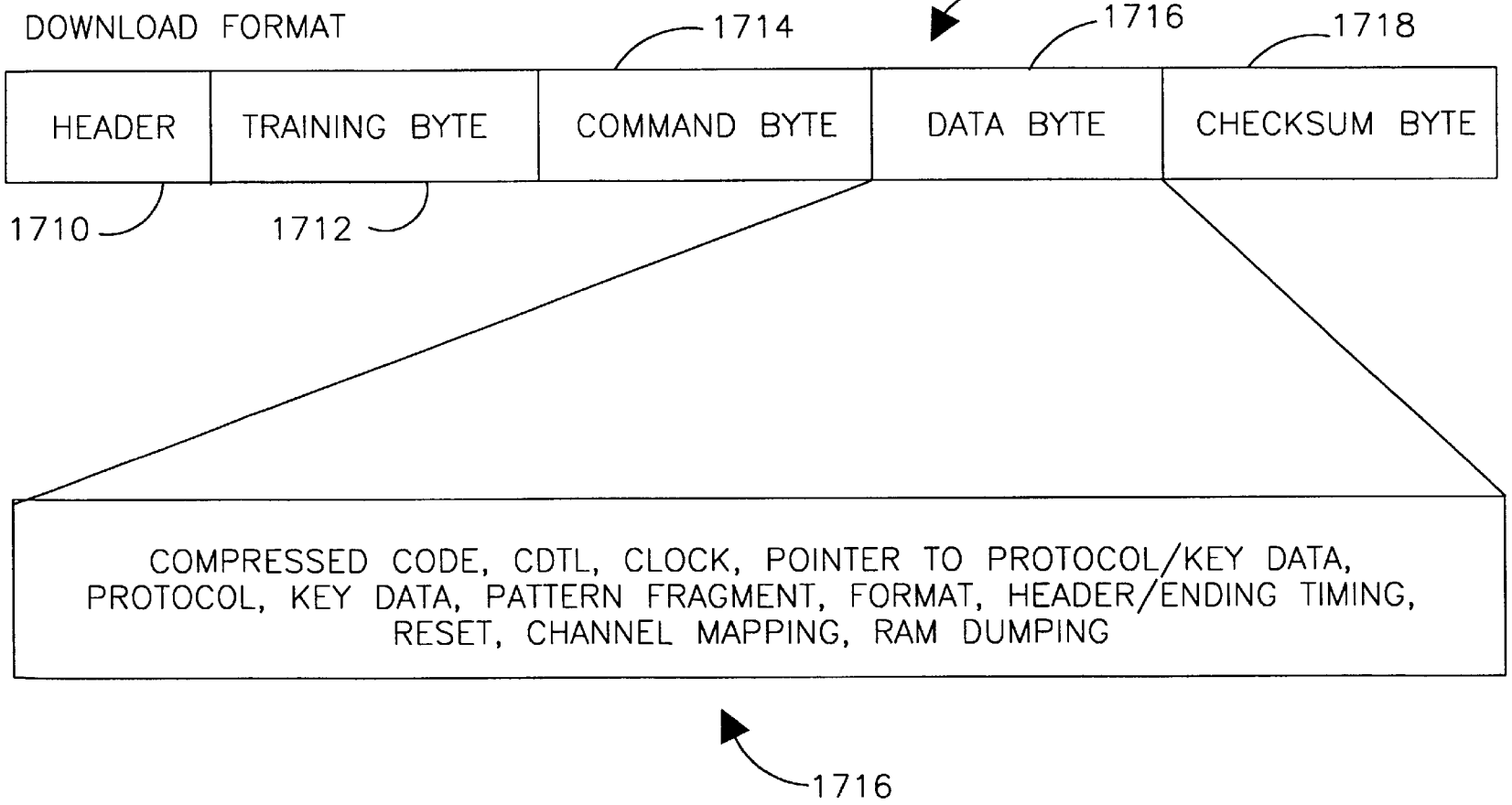
FIG. 11 is a diagram illustrating the download format which contains a header, training byte, command byte, data bytes, and checksum byte, according to an embodiment of the invention.

FIG. 11 shows the download format 1700 for downloading information to the custom programmer 1100 or the telephone set 1550 via telephone. Each binary bit that is sent for the download via telephone is represented by three sine wave cycles of the same frequency. Bit 1 is three cycles of 1.8 kHz and bit 0 is three cycles of 2.8 kHz. The receiver, such as the custom programmer, locks onto the middle cycle and detects whether it is binary 0 or 1.

The header 1710 consists of 10 leading binary zeros and ones and is followed by a training byte 1712, a command byte 1714, a series of data bytes 1716, and the last byte, which is check sum byte 1718. The total number of the data bytes depend on the command byte 1714, but the maximum number should not be greater than 13. Every byte will be nine bits long with one bit of odd parity.

The training byte 1712 is defined as binary 1010 0101, or Hex A5 with the parity binary 1. The command byte is used to explain the data that follows the command byte. For example, the command byte for a compressed code, may be 1000 0000 (80H) and the command byte for the clock data may be 1001 0000 (90H). The command types include: compressed code, CDTL, clock, pointer for a device, protocol, key data, pattern fragment, format, header/ending timing, reset, channel mapping and RAM dumping.

Compressed Code

If the data is a compressed code, then the data is 6 bytes long. The unused nibble/bytes will be filled with FXH or FFH. The last byte is the record frequency—C1H is ONCE, C2H is WEEKLY and C3H is for DAILY.

For example, 1234 ONCE will be

FFH, FFH, FFH, 12H, 34H, C1H.

Another example, 12345 DAILY will be

FFH, FFH, F1H, 23H, 45H, C3H.

CDTL

If the data is CDTL, then the data is 7 bytes long. The first byte is the guide channel number. The second byte is the day. The third byte is the start hour and then the start minute in 24 hour format. The fifth byte is the hours of program length and followed by the minutes of program length. The last byte is the ONCE, WEEKLY or DAILY. All data are in Hex form. The ONCE is represented by C1H, WEEKLY by C2H and DAILY by C3H.

For example, a program of date 12, channel 28, and start at 22:00 for half hour will be

1 CH, 0CH, 16H, 00H, 00H, 1EH, C1H.

Clock

Clock data is 6 bytes long. The first byte is YEAR and then, MONTH, DAY, HOUR, MINUTE and SECOND. All data are in Hex form. The hour is a 24 hour clock.

For example, the data for Jun. 8, 1993 at 12:25 is:

5DH, 06H, 08H, 0CH, 19H, 00H.

Pointer for a Device

If the data is a Pointer for a Device, then the data is 3 bytes long. The first byte is the device name. 01 for VCR, 02 for CABLE, 03 for TV and 04 for AUX. The second and third bytes are pointers to the protocol and key data for the device. This setting is used for a KNOWN device that is a device with entries stored in ROM in the remote controller.

For example, if a user wants to set the VCR and TV only, he tells the representative that his VCR is JVC VR-123 and his TV set is Hitachi model 2. The setting will be:

01H, 11H,0CH VCRbrand 12,00-17

03H, 02H, 13H TV brand 19, 00-02.

If the second byte is EXH (X=1–4), it is a download mode. E1H for VCR code, E2H for cable code, E3H for TV code and E4H for AUX code. For example, if a user has a VCR which is not compatible to the entries stored in the ROM, then the setting will be 01H, E1H, XXH VCR with download data The third byte XXH is the type of E1H if it is an existing type. The third byte will be CXH if it is a New type.

Protocol

Protocol data and in particular the pattern fragment type is 12 bytes long. The protocol data includes a pattern fragment pointer. The set of pattern fragments which can be accessed by the pattern fragment pointer include:

E0 for Interbit pattern

E1 for Pulse pattern

E2 for Reverse Interbit pattern

E3 for High Low pattern

E4 for Serial pattern

E5 for Missing pulse pattern

Also included in the protocol data is a format pointer. A set of format types, which can be accessed by the format point include:

A1 DX

A2 ADX

A3 HDX

A4 HADX

A5 D

A6 AD

A7 HD

A8 HAD

AF HADADXEY

The 4th to 7th bytes store the timing information of binary 0 while the 8th to 11th bytes store the timing information of binary 1. For example, the 4th and 5th bytes are interbit pattern timing for binary 0 from 1 us to 65 ms and the 6th and 7th bytes are the timing of binary 0 from 1 us to 65 ms with a resolution of 1 us.

The last (12th) byte is the Carrier frequency (CF) from 0.5 to 120 us in steps of 0.5 us. If the CF byte is 00H, it means 400 kHz carrier frequency.

Kea Data

The key data is the data for each key and is 10 bytes long. The first byte is the mode byte from E1H to E4H, which identifies the device. The second byte is the key name number. Every 10 bytes stores key data for two keys. For example, ABH stores the key data for "Power" and "Record".

Sets of Pattern Fragments and Formats

The sets of pattern fragments and formats (see FIGS. 13 and 14) can be sent in the data bytes.

Header and Ending

The timing for the Header and Ending is 10 bytes. The first byte is the type number C1H to C4H followed by the CEH if it is a Header or CFH if it is an Ending. The 3rd to 10 bytes store the timing information.

Reset

A reset data code is one byte long. It contains a special reset code to set the remote controller in an initial condition.

Channel Mapping

Data for channel mapping, which is a mapping between local channels and cable channels is 11 bytes long. The first byte stores the total number of mapped channels. The second and third bytes are a pair of local and cable channels. The fourth and fifth bytes for the next pair and so on.

RAM Dumping

Data for RAM dumping is used for directly dumping the RAM memory via the telephone. The first byte is the ADDRESS of the first data location and then the total number of bytes to be dumped follows. A total of 10 RAM locations can be downloaded for each download format 1700. This feature allows a remote site to access to the RAM contents.

The checksum byte is the exclusive OR (XOR) of all the data bytes and is also 9 bits long. Data will not be accepted if the check sum is incorrect.

FIG. 12 is a schematic of a portion of custom programmer 1100, the telephone set 1550 or an universal remote controller according to this invention. The portion shown in FIG. 12 includes a microcomputer 1800, IR transmitter 1802, a keypad 1804 and an interface 1806 through which downloaded information can be passed to RAM 1830. As shown in FIG. 12 the interface 1806 can be coupled directly to a telephone line 1820, as is the case for telephone set 1550 or via the telephone 1822 and the telephone earpiece 1824 through microphone 1808, which corresponds to microphone 1162 of custom programmer 1100. Another path for downloading information to the interface is via audio player 1826 and speaker 1828 and microphone 1808. For example, a user may obtain a tape which can be played on the audio player. The tape has recorded audio which is in the same format as the downloaded information via the telephone 1822. When the downloaded information is received by the interface then the information is stored in RAM 1830 via databus 1801 and address bus 1803. The databus 1801 and the address bus 1803 are coupled to the microcomputer 1800, ROM 1850, and RAM 1830.

In the implementation of FIG. 12, device protocols and key data are stored in ROM 1850. Also stored in ROM 1850 are a set of pattern fragments and a set of formats. Illustrated in FIG. 12 are device 1 protocol 1852, device 2 protocol 1854 and device N protocol 1855. Also illustrated in FIG. 12 are device 1 key data 1870, device 2 key data 1872 and device N key data 1873. The pattern fragments are shown as the set E1 to EN (1880) and the formats are shown as the set A1 to AM (1890). Each protocol consists of a pattern fragment pointer, a format pointer, a zero timing, a one timing and a carrier frequency. The key data consists of data that is transmitted to an appliance or device when a key on the remote controller is pressed.

The ROM 1850 can also store X wait pattern 1893, Y wait pattern 1894, Header 1895 and Ending 1896.

As described above in the download format descriptions, pointers to the protocol and key data can be downloaded. The pointers to the protocol and key data are stored in RAM 1830 as indicated by VCR pointer 1832 and cable pointer 1834. The pointer 1832 is a mapping between a device model number and a pointer to the protocol/key data. This allows the microcomputer 1800 to access the protocol and key data for a particular device such as a VCR. The protocol and key data are used to generate codes that are transmitted to control an appliance or device.

As described above, the device protocol contain a pattern fragment pointer and a format pointer, such as pattern pointer 1856 and format pointer 1858 shown in FIG. 12. These pointers point to a particular pattern fragment in the set of pattern fragments 1880 and a particular format in the set of formats 1890.

FIG. 13 is a table showing the pattern fragment names, and the pattern fragments for a 0 bit and a 1 bit. The first pattern fragment type is called the Interbit pattern (EO) and has a pattern fragment name E0 (element 2000). Appliances that use this type of pattern fragment are sensitive to delay time for distinguishing a 0 and a 1 bit. As shown, the 0 bit (2010) has a shorter delay time than the 1 bit (element 2012). The appliances look for a trigger which is just a short period of infrared carrier frequency, and then the appliance waits to see how long the delay is until the next trigger. The next pattern fragment type is called the Pulse type (E1) and it is similar to the Interbit pattern, but the trigger is short compared to the Interbit pattern. The next pattern fragment (E2) is called the Reverse Interbit pattern and it is similar to the Interbit pattern except the infrared carrier time is what differentiates a 0 from a 1 bit. The wait time does not change. The next pattern type (E3) is called the High-Low pattern fragment type. A 0 bit has silence and then infrared carrier. A 1 bit has infrared carrier then silence. The next pattern fragment type is the Serial pattern fragment type (E4). In this pattern a 0 bit and a 1 bit take exactly the same amount of time to transmit. A 0 bit is a set amount of time of infrared carrier and a 1 bit is a set amount of time of silence, or no infrared carrier. Another pattern (E5) is called the Missing Pulse pattern fragment type and for this pattern fragment the difference between a 0 bit and a 1 bit is the "count" of pulses in a fixed amount of time. Each pulse has approximately the same number of carrier frequency cycles contained within the pulse.

FIG. 14 is a table of the set of formats for transmitting codes to control an appliance. Any particular appliance uses one of the formats in the set of formats. For example, the A1 format (element 2030) has a format DX. The corresponding description for DX is data, wait. The data that is inserted into the data portion of the format is retrieved from the key data for the device. Another format is format A2 (element 2034) that has an address, data, wait format which can be abbreviated as ADX. The address is just another series of databits. For example, a Sony VCR may have an address of 0100, and a second Sony VCR may have an address of 1001. The same data value of 150 may represent "power" but each of the Sony VCRs will only respond to the correct address. So if the data value for 150 is 10010110, to send power to Sony VCR no. 1 the databits 010010010110 must be sent. To send power to Sony VCR no. 2 the databits would be 011110010110.

The X and Y wait values in a format are additional infrared carrier and delay times that usually appear at the end of the databit. In some formats such as format A4 (element 2038) the format is HADX, which is header, address, data and wait. The header is essentially a code that is sent to the appliance to wake up the appliance so that it can receive the following address and databits. Another format type is format AF (element 2039) which is a format of header, address, data, inverse address, inverse data, wait ending, and wait. In this format the address and data are sent in both a positive and an inverse mode so that the appliance that receives the address and data can check whether the address and data are properly received.

The X wait, Y wait, header, and ending can be stored in ROM 1850, as shown in FIG. 12 elements 1893, 1894, 1895 and 1896.

Figures 15, 22:
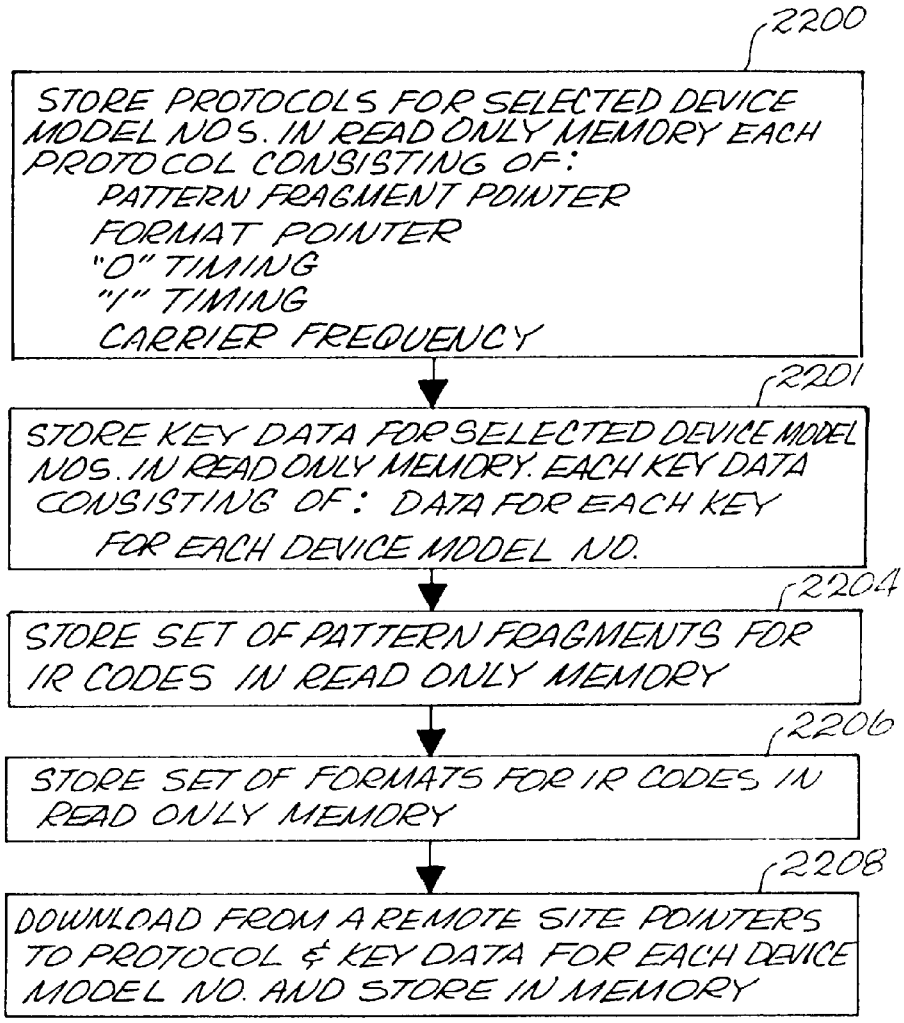
FIG. 15 shows pointers to protocols and key data stored in a RAM that point to protocols and key data stored in a ROM that also contain pointers to pattern fragments and formats, according to an embodiment of the invention.
FIG. 22 is a flow diagram of a method for initializing a universal remote control including storing protocol and key data pattern fragments and formats in the universal remote control and downloading pointers to protocol and key data for devices to be controlled, according to an embodiment of the invention.

FIG. 15 illustrates some example key data. Key data corresponds to each key that will be used to send commands to an appliance. For example, for the pause key 2120 the key data is 001011 (element 2122). The key data is inserted into the D field of the format.

Figure 16:
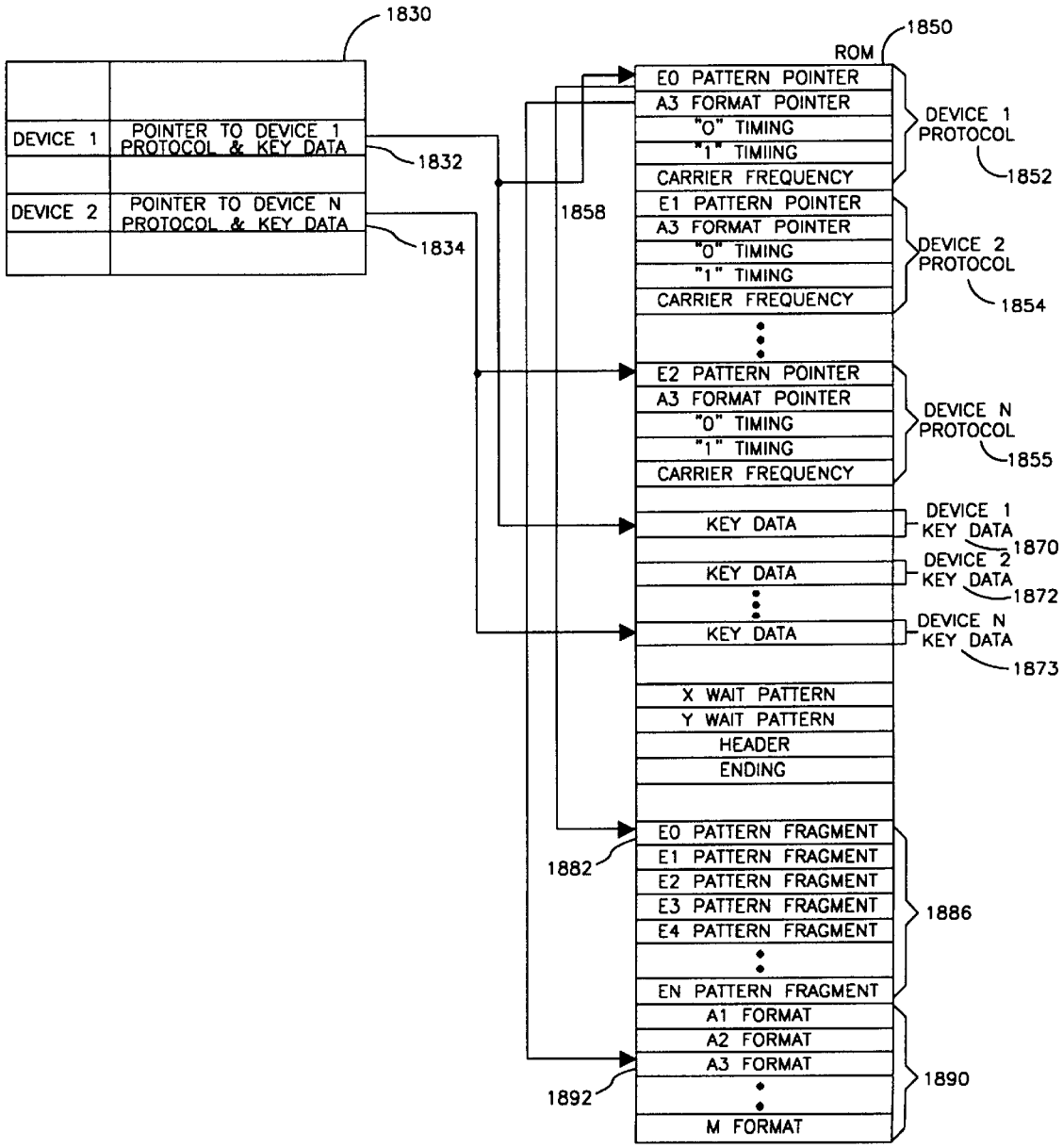
FIG. 16 illustrates a timing diagram showing how a pattern fragment and format are used to construct an IR code, according to an embodiment of the invention.

FIG. 16 illustrates how the pointers to the device protocol and key data are used to access the data from the ROM 1850 in order to generate a code to control an appliance. When the user presses a key on the remote controller which can be, for example, custom programmer 1100 or telephone set 1550, including the cordless telephone 1552, the microcomputer 1800 uses the corresponding pointers to the protocol and key data to access the protocol and key data for a particular device. For example, if device 1 as shown in FIG. 16 is being controlled then the pointer 1832 will be accessed from RAM 1830 and used to access device 1 protocol 1852 and device 1 key data 1870 from the ROM 1850. If the remote controller is used to control device N then the pointer 1834 will be accessed from RAM 1830 in order to access device N protocol 1855 and device N key data 1873 from the ROM 1850. When a protocol has been accessed from the ROM the pattern fragment pointers and the format pointers such as pattern pointer 1852 and format pointer 1858 are used to access a pattern fragment and a format such as pattern fragment 1882 and format 1892, as shown in FIG. 16. As shown device 1 protocol uses pattern fragment type E0 and format type A3. Note that device N and device 1 both use format type A3. By storing the pattern fragments separately, as shown in pattern fragment set 1880, memory in the remote controller is saved.

Figure 17:
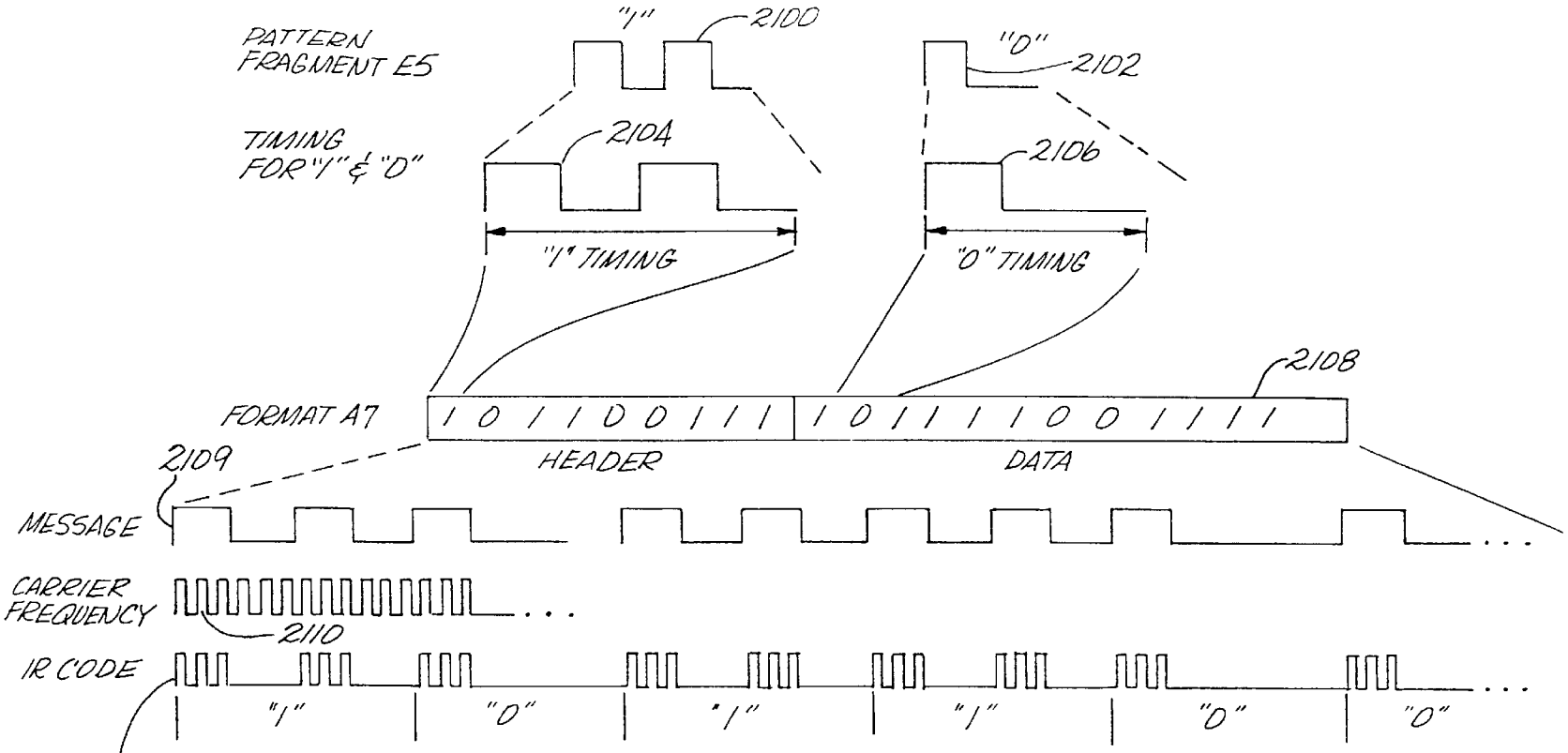
FIG. 17 is a table showing the relationship of a key to output data for that key according to an embodiment of the invention.

FIG. 17 illustrates how device protocol and key data are combined to generate an infrared code for transmittal to the appliance being controlled. For example, suppose the protocol indicates that pattern fragment E5 which is a Missing Pulse pattern fragment type is to be used. The protocol also indicates a one timing and a zero timing. A 1 is generated as a combination of the pattern fragment for a 1 (element 2100) and the timing for a 1 (element 2104). A 0 is formed by the pattern fragment for a 0 (element 2102) and the timing for a 0 (element 2106). Also suppose that the protocol indicates that format type A7 is used which consists of a header followed by the data, which is in this case key data 2108. By combining the pattern fragment, the timing for 0, the timing for 1, and the format type, a message 2109 can be generated. Then, the carrier frequency 2110 as indicated in the protocol is mixed with the message 2109 to generate infrared code 2112 which is then transmitted to the appliance.

Figure 18:
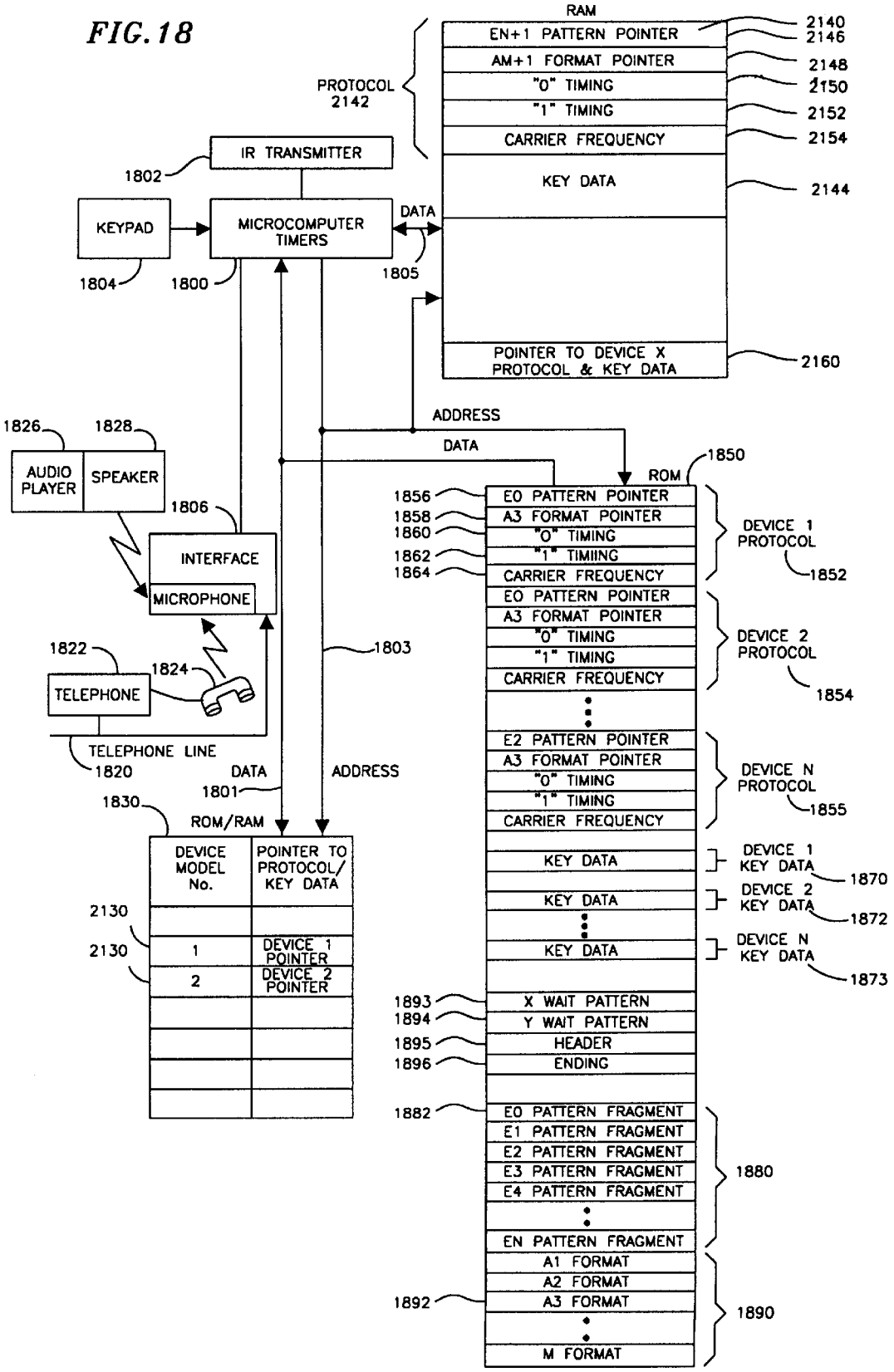
FIG. 18 is a schematic for a universal remote controller having apparatus for downloading a device protocol and key data and a pointer to the device protocol and key data according to an embodiment of the invention.

In another embodiment the downloaded data from the telephone line 1820, the telephone earpiece 1824 or the speaker 1828 includes protocol and key data for an appliance that does not have device protocol and key data stored in ROM 1850. In order to send commands to the new appliance which is not contained in the protocol and key data of the ROM 1850, it is necessary to download the protocol for the new device and the key data for the new device into RAM 2140, as shown in FIG. 18. As described above for devices that already have a protocol and key data stored in ROM 1850, it is only necessary to download a pointer to the device protocol and key data into RAM 1830.

As shown in FIG. 18 a pointer 2160 to the protocol and key data for device X has been downloaded and stored in RAM 2140. Also stored in RAM 2140 is downloaded protocol 2142 which consists of a pattern fragment pointer 2146, a format pointer 2148, a 0 timing 2150, a 1 timing 2152 and a carrier frequency 2154. Key data 2144 has also been downloaded and stored in RAM 2140.

Figure 19:
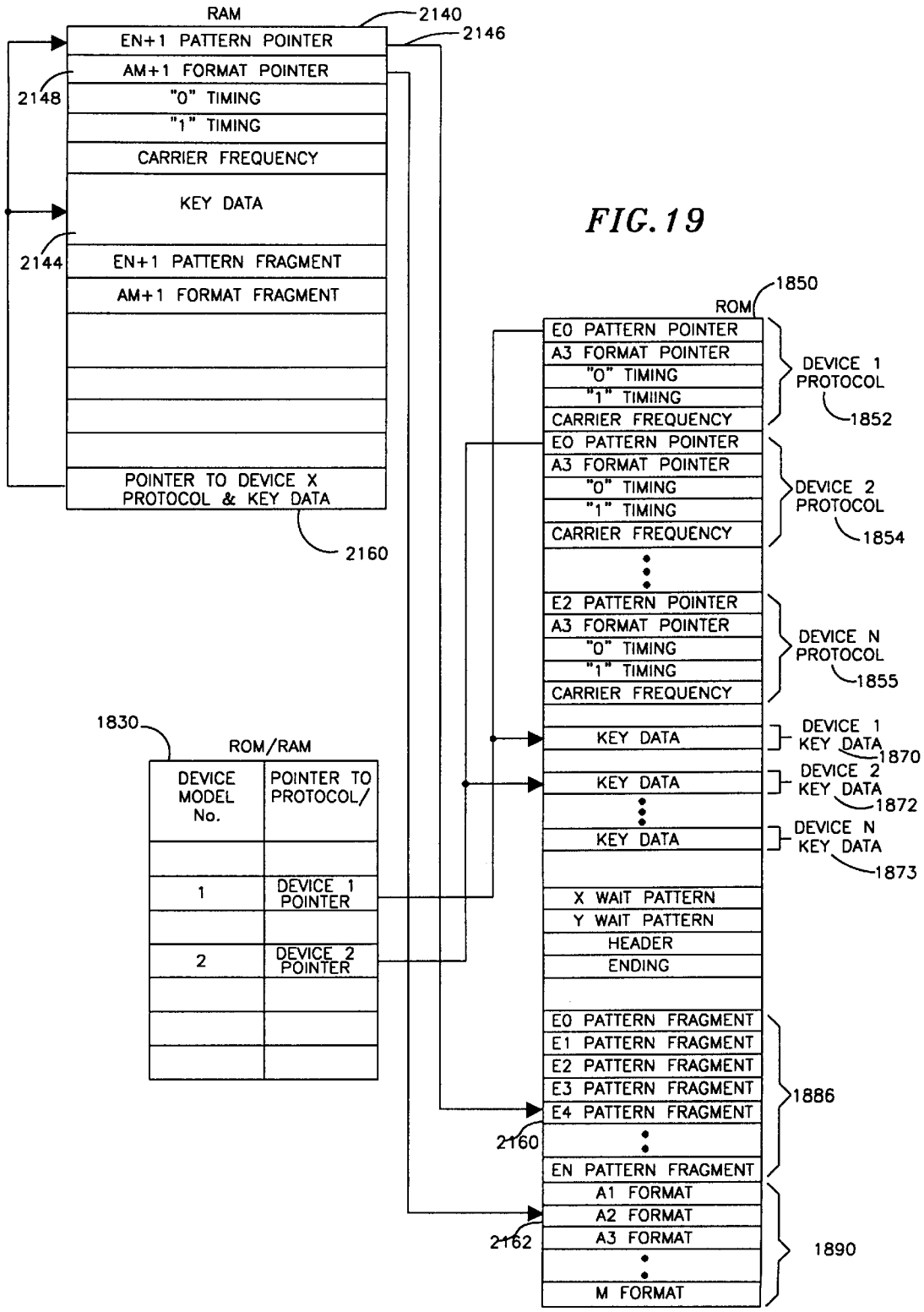
FIG. 19 illustrates a pointer for a device protocol and key data pointing to a protocol and key data stored in RAM and pointers in the protocol for pointing to a pattern fragment and a format, according to an embodiment of the invention.

FIG. 19 illustrates how the data that is downloaded to RAM 2140 is used for generating infrared codes for controlling an appliance. The downloaded pointer 2160 is used to access the protocol for the device 2142 and the key data for the device 2144, which are both stored in RAM 2140. In this case the pattern fragment type is a type that has been previously stored in ROM 1850. This is also the case for the format type for the new protocol. Thus, the pattern fragment pointer 2146 is used to access a pattern fragment from the pattern fragment set stored in the ROM 1850. In this case the pattern fragment accessed is type E4 (element 2160). The format pointer 2148 is used to access format A2 (element 2162) from ROM 1850. The pattern fragment, the timing for 0, the timing for 1, the format, and the carrier frequency of the protocol 2142 are then used to generate an IR code in the manner illustrated in the FIG. 17.

Figure 20:
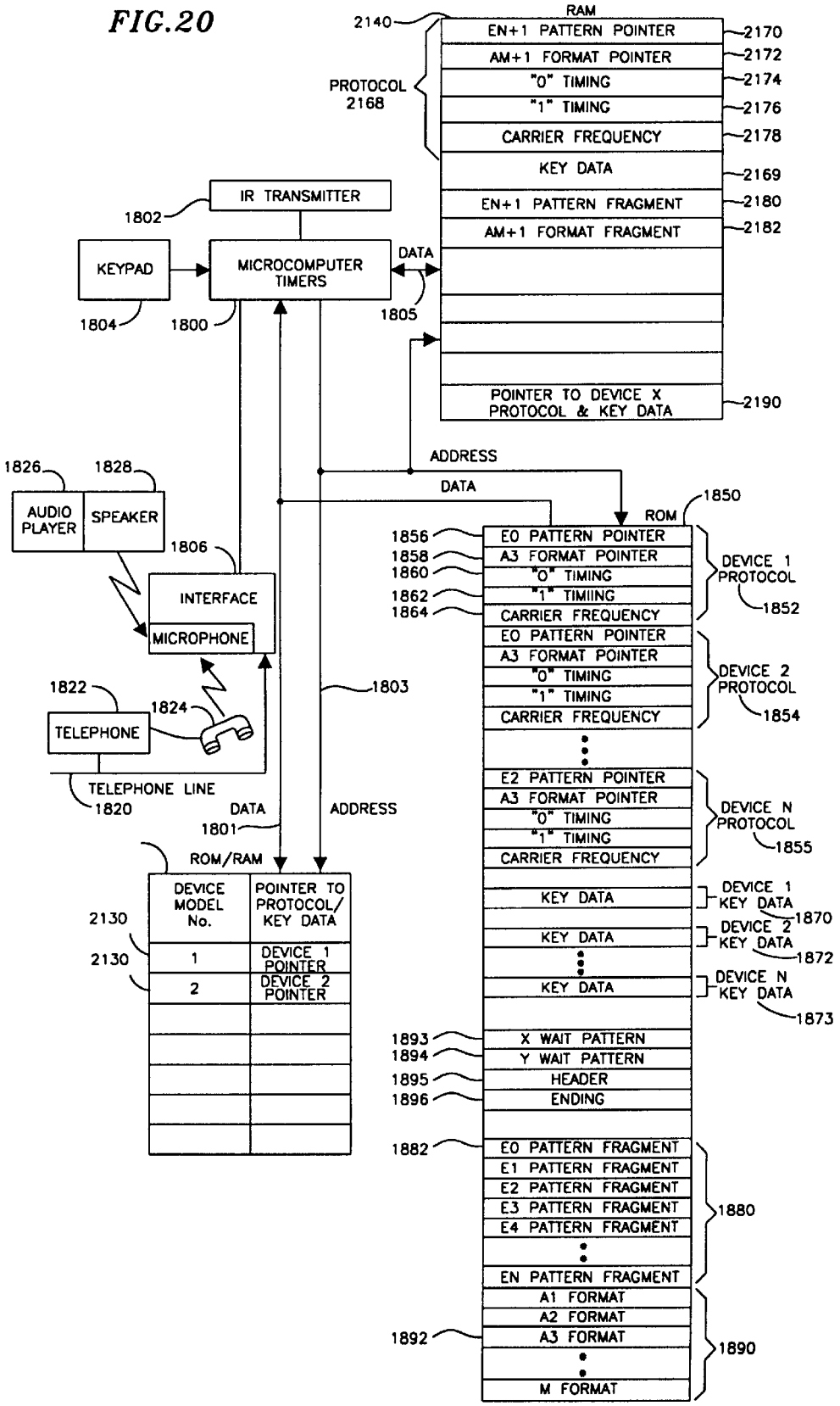
FIG. 20 is a schematic for a universal remote controller having apparatus that allows downloading a pattern fragment and a format to a RAM, according to an embodiment of the invention.

FIG. 20 is similar to FIG. 18 and illustrates data that is downloaded to RAM 2140 when the device to be controlled is a device that does not have protocol, key data, a pattern fragment, and a format stored in ROM 1850 corresponding to the device. The protocol 2168 and the key data 2169 as shown in FIG. 20 are downloaded for the new device X in the same manner as protocol 2142 and key data 2144 shown in FIG. 18. Pointer 2190 which points to the protocol and key data is also downloaded and stored in the RAM 2140. In this case there is not a proper pattern fragment or format stored in the pattern fragment set 1880 and the format set 1890, respectively, corresponding to the pattern fragment and format that is used by device X. Thus, pattern fragment 2180 and format 2182 are downloaded via interface 1806 and stored in RAM 2140.

Figure 21:
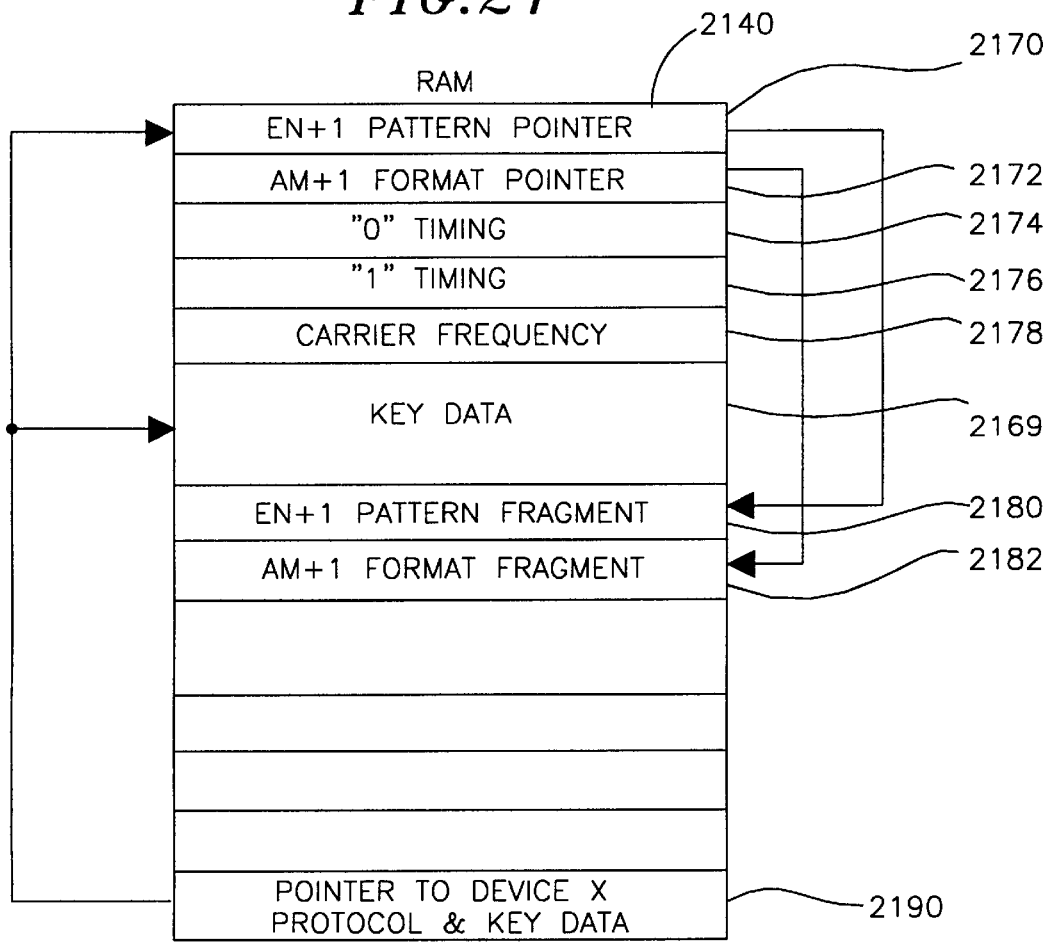
FIG. 21 is a diagram showing a pointer to a device protocol and key data in a RAM pointing to a protocol and key data stored in the RAM wherein the protocol contains pointers to a pattern fragment and format stored in the RAM according to an embodiment of the invention.

FIG. 21 shows how the information that is downloaded and stored in RAM 2140 is used to generate infrared codes to control an appliance. The pointer 2190 is used to access the protocol 2168 and the key data 2169 for the device. Then the pattern fragment pointer 2170 is used to access pattern fragment 2180 and the format pointer 2172 is used to access the format 2182. The pattern fragment 2180, the format 2182, the timing for a 0 2174, the 1 timing 2176, and the carrier frequency 2178 are used in the manner illustrated in FIG. 17 to generate an IR code.

Methods for using downloaded information to generate infrared codes for controlling an appliance are now described. FIG. 22 is a flow diagram for storing or downloading and storing the information required to generate IR codes. In step 2200, protocols for selected device model numbers are stored in read only memory, such as read only memory 1850. In step 2202 key data for selected device model numbers are stored in read only memory. Each key data consists of data for each key for each device model number. Each protocol consists of a pattern fragment pointer, a format pointer, a 0 timing, a 1 timing and a carrier frequency. In step 2204 a set of pattern fragments for generating codes are stored in read only memory. Then in step 2206 a set of formats are stored in read only memory. Then, in step 2208 pointers to protocol and key data for each device are downloaded from a remote site and stored in a memory.

Figure 23:
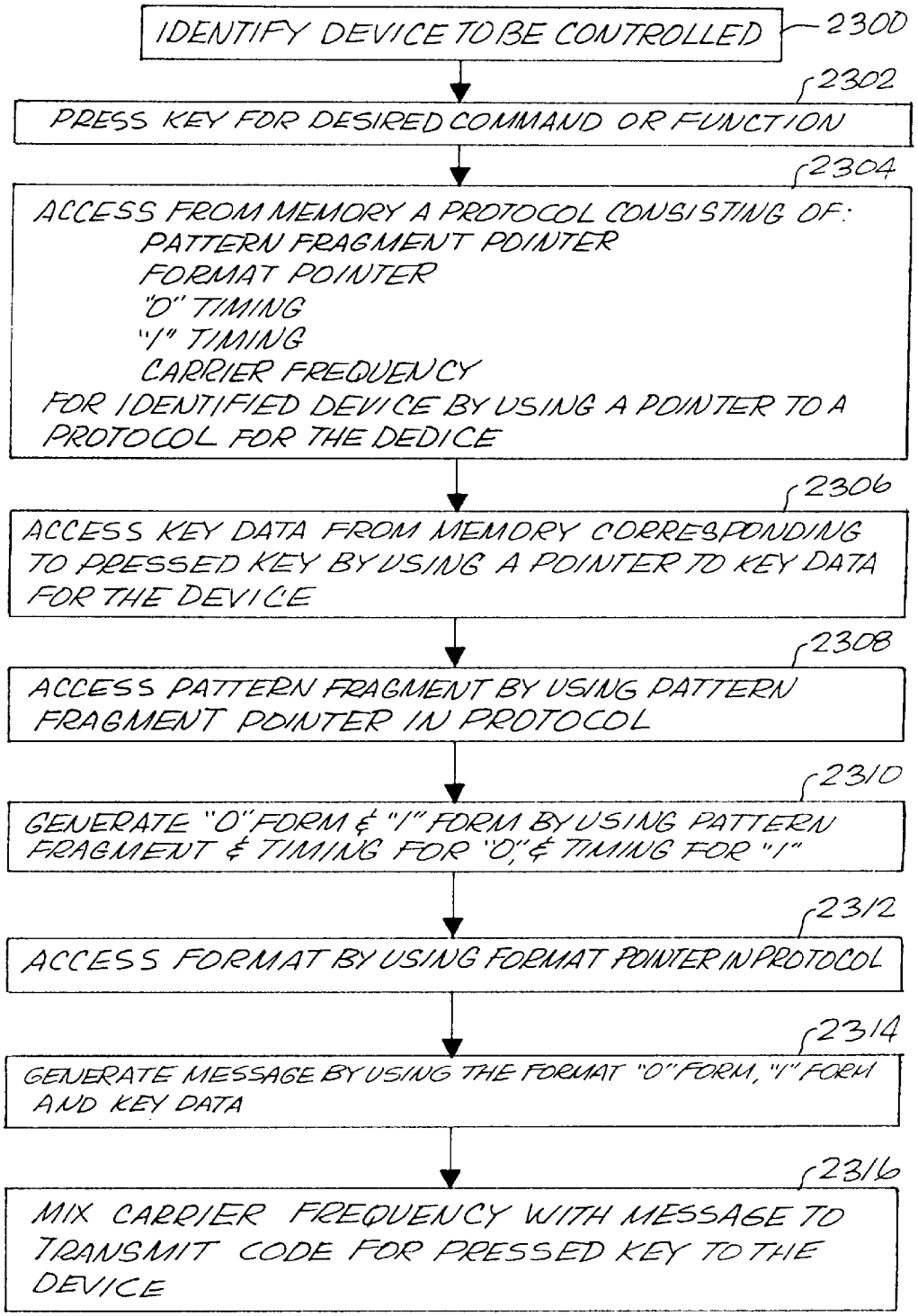
FIG. 23 is a flow diagram for a method of generating codes for controlling appliances from a remote controller using pattern fragments stored in the remote controller according to an embodiment of the invention.

FIG. 23 describes a method of using stored information for generating codes for a device to be controlled by a remote controller. In step 2300 the device to be controlled is to be identified. Then in step 2302 a key for the desired command or function is pressed on the remote controller. Then in step 2304 a protocol consisting of a pattern fragment pointer, a format pointer, a 0 timing, a 1 timing and a carrier frequency are accessed from memory for the identified device by using a pointer to a protocol for the device. Then in step 2306, key data corresponding to the pressed key is accessed from memory by using a pointer to key data for the device. In step 2308 a pattern fragment is accessed by using the pattern fragment pointer in the protocol. Then in step 2310, a 0 form and a 1 form are generated by using the pattern fragment and timing for a 0 and a 1. Then in step 2312 the format is accessed by using the format pointer in the protocol. Then in step 2314 a message is generated by using the format, the 0 form, the 1 form, and the key data. The message is then mixed with a carrier frequency in step 2316 to form an infrared code that is transmitted to the appliance or device to be controlled.

Figure 24:
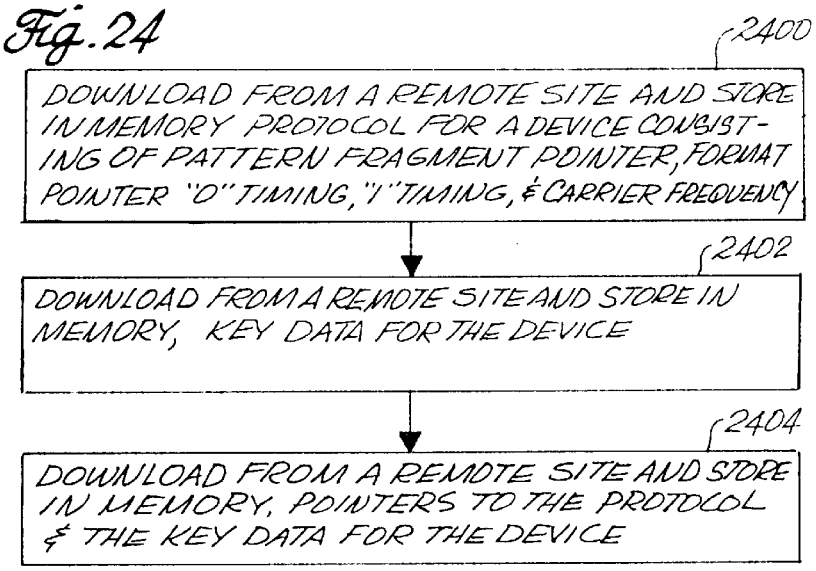
FIG. 24 is a method for downloading to a universal remote controller the protocol and key data for controlling an appliance according to an embodiment of the invention.

The method described in FIG. 24 is illustrated in FIG. 17 and can be used for generating codes by the remote controllers of FIG. 12, FIG. 18, and FIG. 20, which operate with varying downloaded data. For the remote controller of FIG. 12 the downloaded data is the data shown in step 2208 of FIG. 22. For the remote controllers of FIGS. 18 and 20 the downloaded data and a method for downloading the data are illustrated in FIGS. 24 and 25, respectively.

In step 2400 of FIG. 24 a protocol is downloaded from a remote site and stored in memory. The protocol for a device consists of a pattern fragment pointer, a format pointer, a zero timing, a 1 timing and a carrier frequency. In step 2402 key data for the device consisting of data for each key is downloaded from a remote site and stored in memory. Then in step 2404 pointers to the protocol and the key data are downloaded from a remote site and stored in memory. In the case of the remote controller of FIG. 18, the set of pattern fragments and the set of formats are stored in a read only memory in the same manner as steps 2204 and 2206 of FIG. 22.

Figure 25:
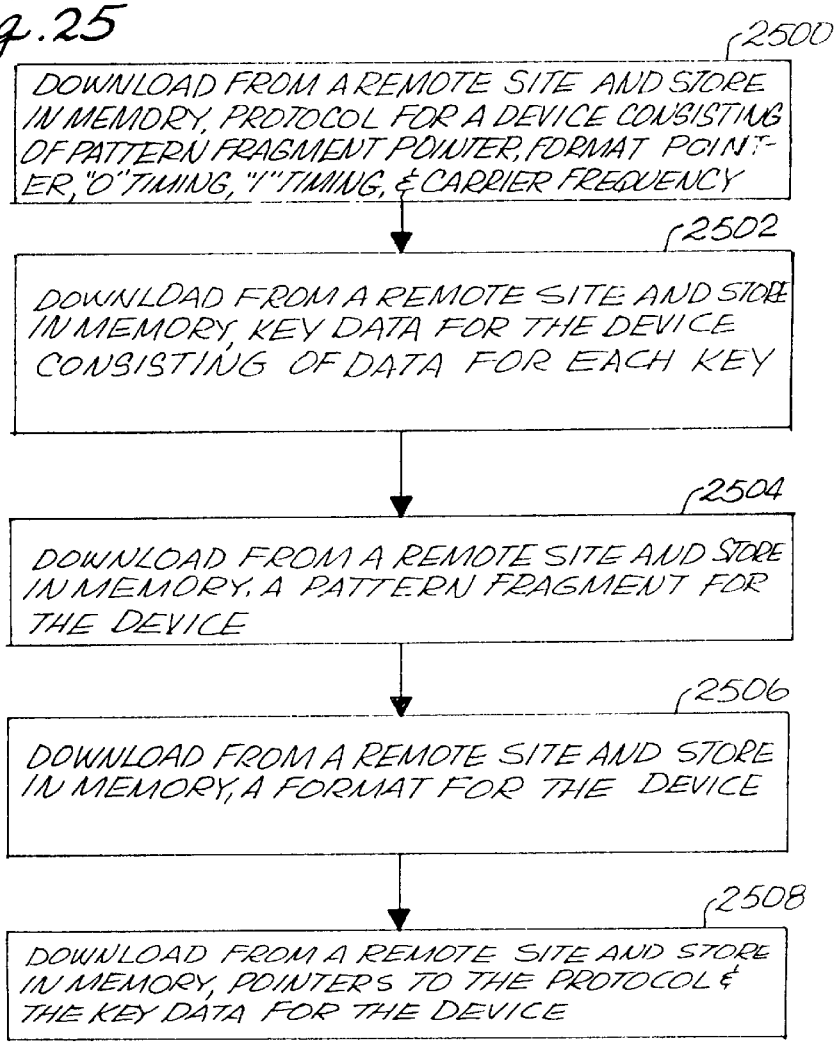
FIG. 25 is a flow diagram for a method of downloading to a remote controller a device's protocol, key data, pattern fragment, and format according to an embodiment of the invention.

FIG. 25 illustrates a method for downloading information from a remote site to the remote controller of FIG. 20. In step 2500 a protocol for a device is downloaded from a remote site and stored in memory. The protocol consists of a pattern fragment pointer, format pointer, 0 timing, 1 timing, and a carrier frequency. In step 2502 key data for the device consisting of data for each key is downloaded from the remote site and stored in memory. Then in step 2504 a pattern fragment that can be used to generate 0's and 1's for the device is downloaded from the remote site and stored in memory. In step 2506 a format that can be used to generate codes for the device is downloaded from the remote site and stored in memory. Finally, in step 2508 pointers to the protocol and the key data for the device are downloaded from a remote site and stored in memory.

FIG. 26 shows a representative set of download data that would be downloaded for device A.

Figure 27:
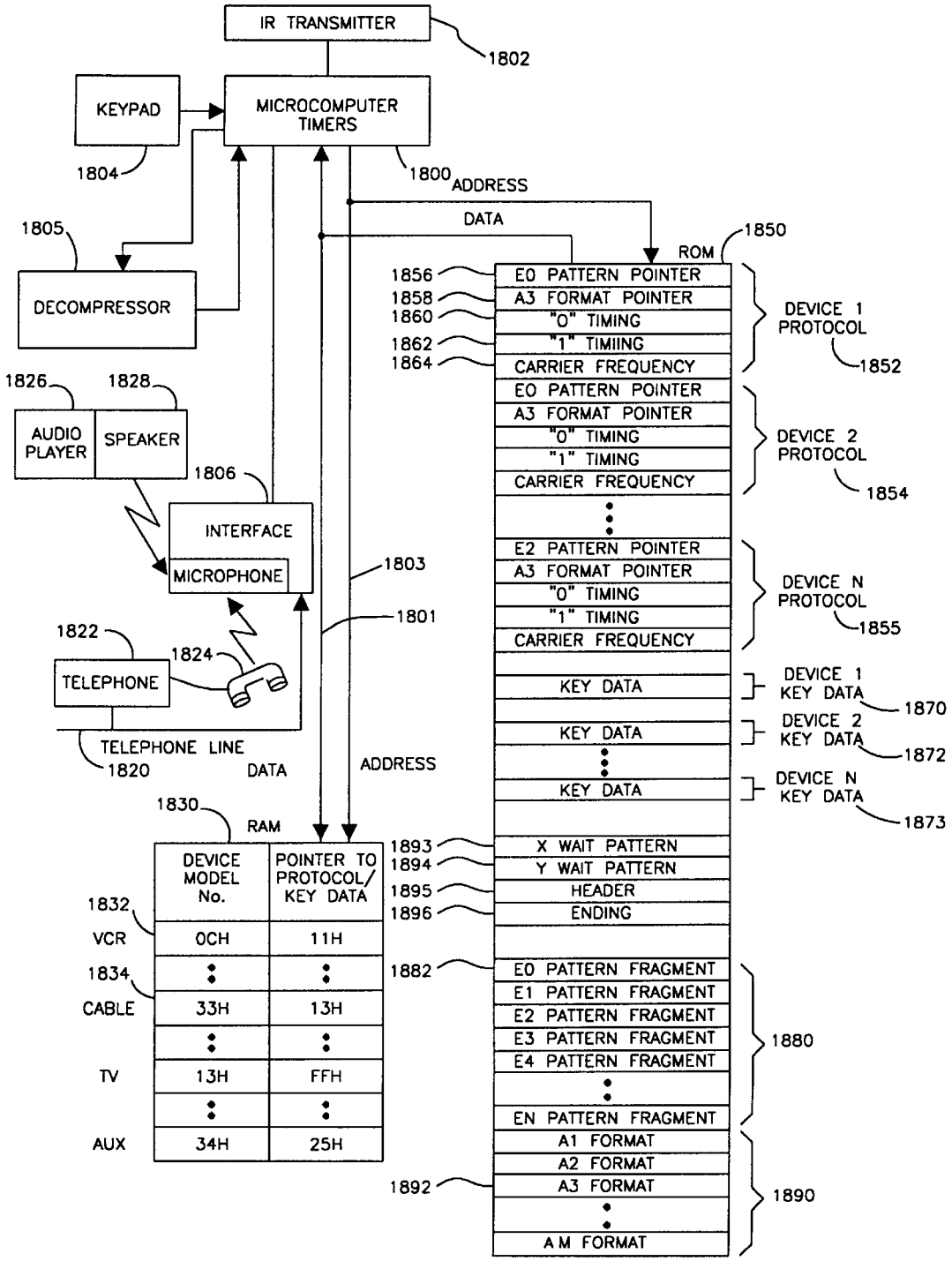
FIG. 27 is a schematic of a remote controller similar to the remote controller of FIG. 12 with the addition of a decompressor for decompressing entered information according an embodiment of the invention.

FIG. 27 is a schematic of a remote controller and is very similar to FIG. 12. FIG. 27 differs from FIG. 12 in that there is an additional element which is decompressor 1805 that has an input from microcomputer 1800 and an output to microcomputer 1800. The remaining portions of FIG. 27 are identical to FIG. 12 and operate in the same manner as the remote controller of FIG. 12. The purpose of the decompressor is to decompress data that is entered in compressed form to the remote controller. As described above, the remote controller of FIG. 27 can be incorporated into custom programmer 1100 or telephone set 1550, including cordless telephone 1552.

Compressed data can be entered into the remote controller via keypad 1804, via telephone line 1820, or via telephone earpiece 1824 or speaker 1828. Once the entered data has been decompressed and stored in RAM then the data is used in the same manner as the data is used in FIG. 12. For example, pointers to the protocol and key data for a device can be entered as compressed data and decompressed by decompressor 1805.

The function of decompressing can be performed by special hardware such as shown in FIG. 27 or the decompression can be performed by microcomputer 1800.

Figure 28:
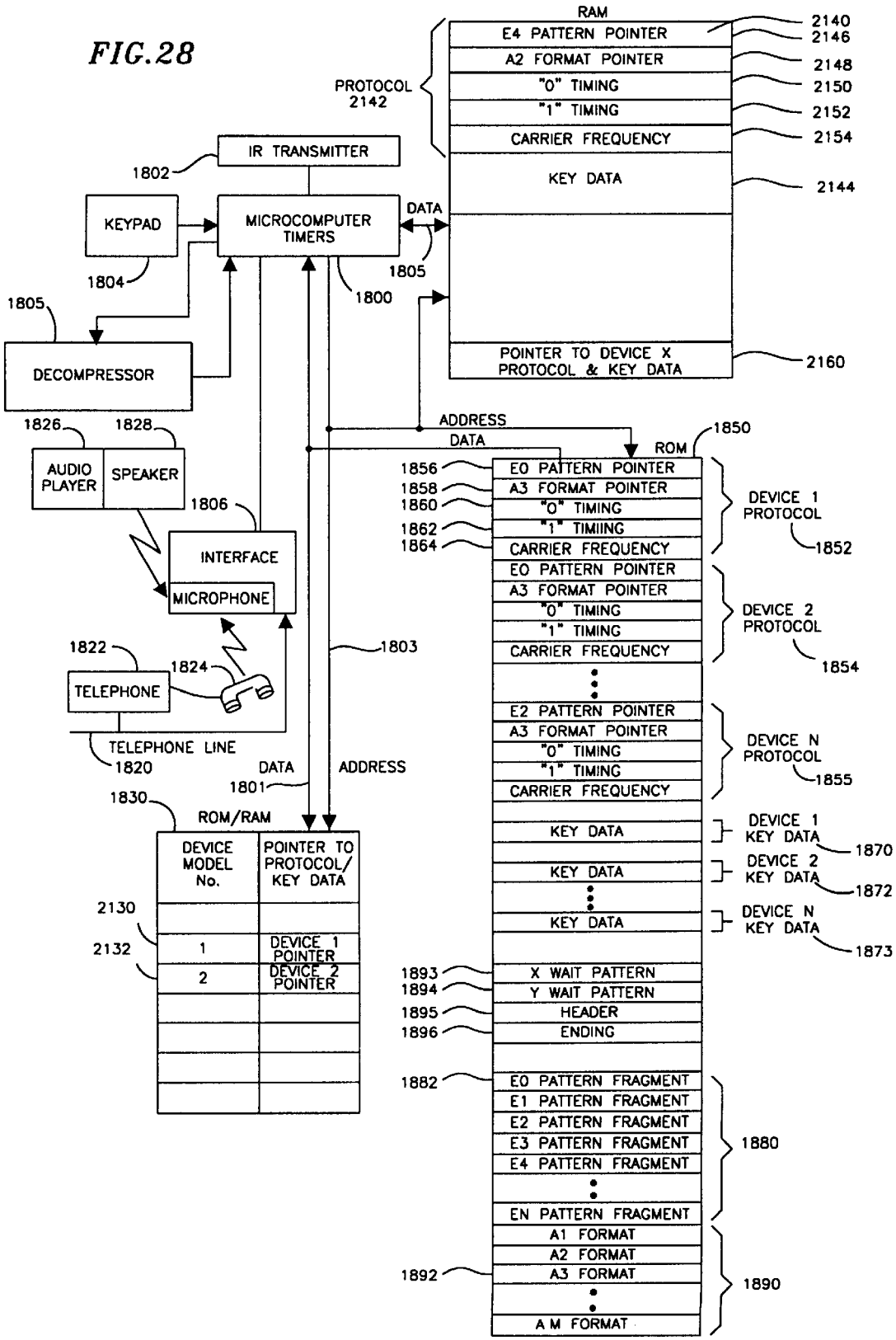
FIG. 28 is a schematic of a remote controller similar to the remote controller of FIG. 18 with the addition of a decompressor for decompressing entered data according to an embodiment of the invention.

FIG. 28 shows a schematic of a remote controller that is similar to the remote controller shown in FIG. 18. However, in the remote controller of FIG. 28 decompressor 1805 has been added and is coupled to the microcomputer 1800. As is the case for FIG. 27, the decompressor 1805 is used to decompress data that has been entered in compressed form. For the remote controller of FIG. 28, which can be incorporated into custom programmer 1100 and telephone set 1550, the entered data which can be decompressed by decompressor 1805, can include protocol data, key data, and pointers to the protocol and key data for a device. The protocol includes a pattern fragment pointer, a format pointer, a zero timing, a one timing, and a carrier frequency. The compressed data that is entered can be entered via keypad 1804, microphone 1808 or a direct connection with telephone line 1802. As is the case for FIG. 27, rather than performing the decompression by decompressor 1805, the microcomputer 1800 can perform the decompression function.

Once the entered data has been decompressed and stored in RAM 2140 then the operation of the remote controller shown in FIG. 28 is identical to the remote controller of FIG. 18.

Figure 29:
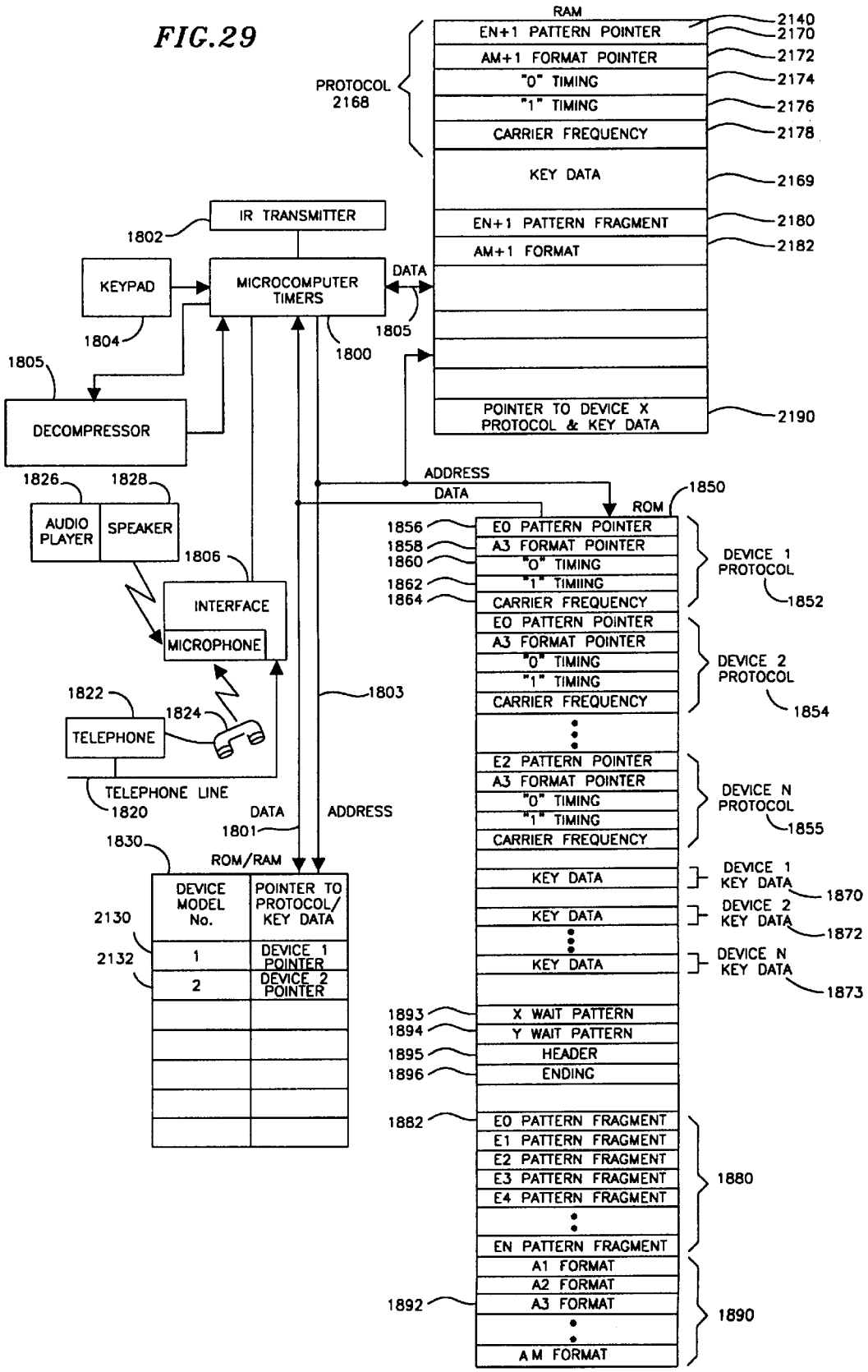
FIG. 29 is a schematic of a remote controller similar to the remote controller of FIG. 20 with the addition of a decompressor for decompressing entered data according to an embodiment of the invention.

FIG. 29 shows a remote controller that is similar to remote controller shown in FIG. 20. The remote controller of FIG. 29 includes a decompressor 1805 which has the purpose of decompressing data that is entered into the remote controller in compressed form. The compressed data can be entered via keypad 1804, microphone 1808 or via direct telephone connection 1820. The decompression function can be performed by decompressor 1805 or by microcomputer 1800. Once the compressed data has been entered and decompressed, then the decompressed data is stored in RAM 2140. Then the remote controller shown in FIG. 29 operates identical to the remote controller of FIG. 20.

Figure 30:
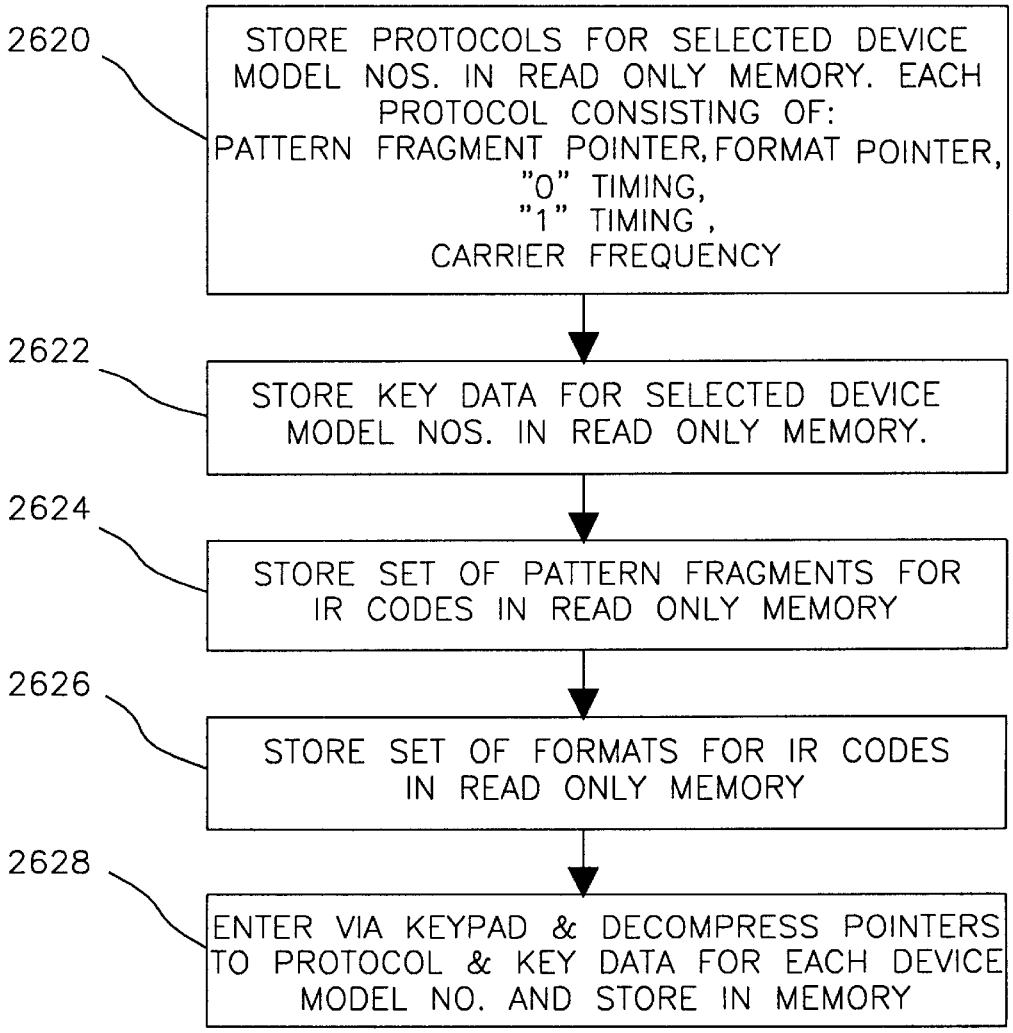
FIGS. 30–32 are flow diagrams for generating codes for controlling appliances from a remote controller including steps of entering data and decompressing the data according to an embodiment of the invention.

FIG. 30 is a flow diagram of a method for generating codes for controlling appliances. In step 2620 protocols for a selected device are stored in read only memory. Each protocol consists of a pattern fragment pointer, a format pointer, a zero timing, a one timing and a carrier frequency. In step 2622, key data for the selected device is stored in read only memory. Then in step 2624, a set of pattern fragments are stored in read only memory and in step 2626 a set of formats is stored in read-only memory. Then in step 2628, pointers to the protocol and key data for a device are entered via a keypad. Then the entered pointers are decompressed and stored in memory. The entry can also be via other forms such as a telephone line or a microphone on the remote controller. Once the steps 2620–2628 have been performed then codes can be generated using the method described in FIGS. 17 and 23. The method of FIG. 30 can be used to store and enter data into the remote controller of FIG. 27.

Figure 31:
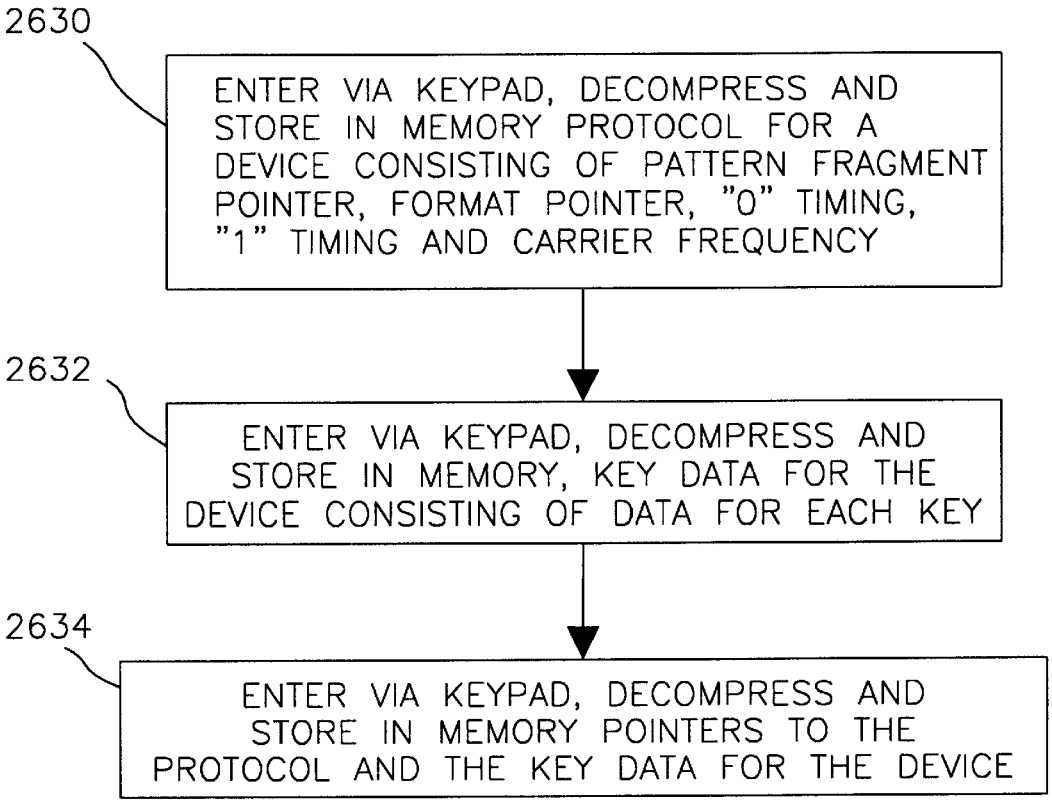

FIG. 31 is a flow diagram of a method for entering data into a remote controller for generating codes for controlling appliances. In step 2630 a protocol for a device is entered via a keypad. The protocol consists of a pattern fragment pointer, a format pointer, a zero timing, a one timing, and a carrier frequency. The entered protocol is decompressed and then stored in memory. In step 2632 key data for the device consisting of data for each key on the device that will be used to control the appliance is entered via the keypad. Then the entered key data is decompressed and stored in memory. In step 2634, pointers to the protocol and the key data for the device are entered via key pad, decompressed and then stored in memory.

The data entered in FIG. 31 via the keypad can also be entered via a telephone line or a microphone on the remote controller.

Once the method of FIG. 31 has been performed and steps 2624 and 2626 of FIG. 30 have been performed then the remote controller shown in FIG. 28 can be used to generate codes for controlling an appliance in accordance with the method described in FIGS. 17 and 23.

Figure 32:
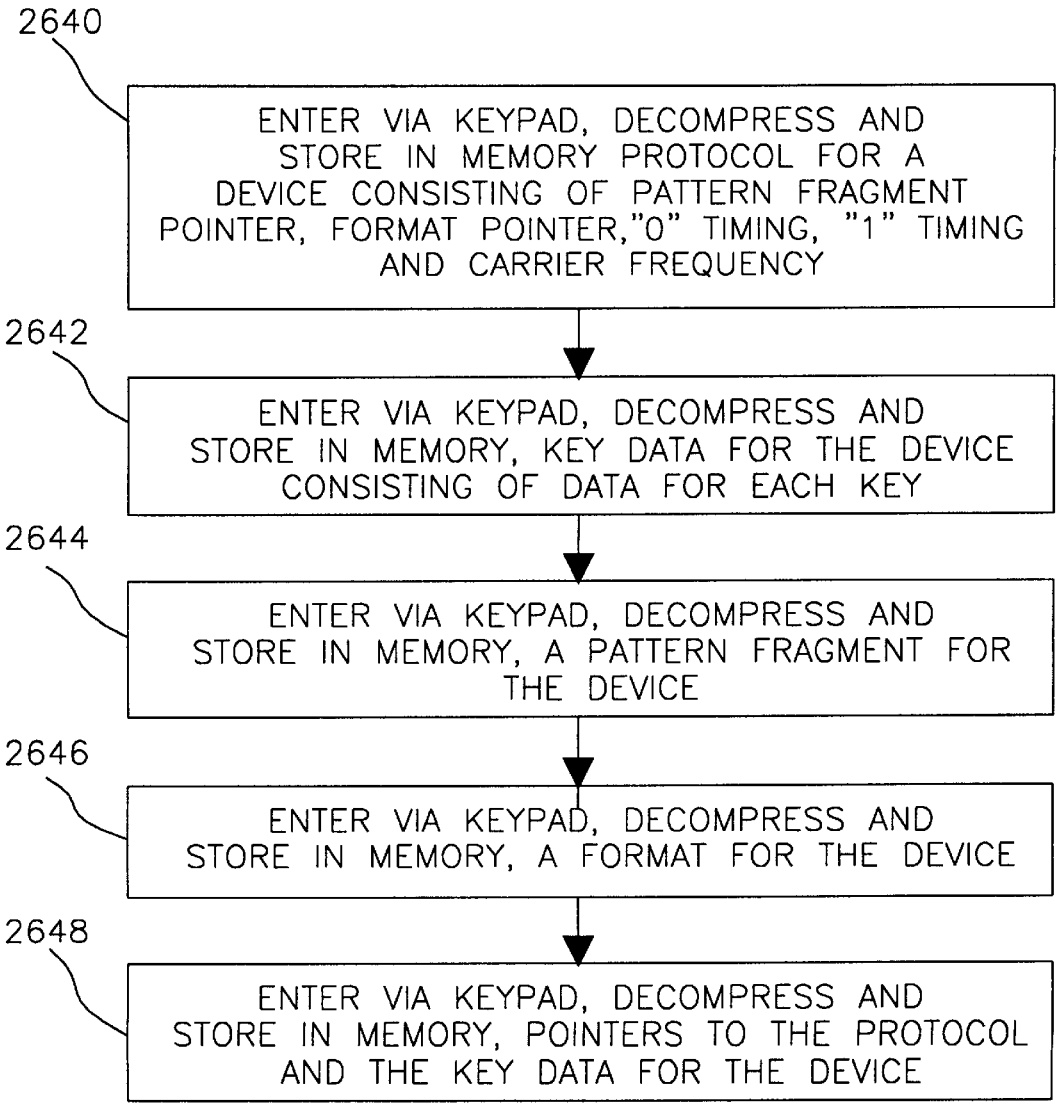

FIG. 32 shows another method for generating codes for controlling an appliance. In step 2640 a protocol for a device consisting of a pattern fragment pointer, a format pointer, a zero timing, a one timing, and a carrier frequency is entered via keypad and decompressed and stored in memory. Then in step 2642 key data for the device consisting of data for each key is entered via keypad, decompressed and stored in memory. In step 2644 a pattern fragment for the device is entered via keypad, decompressed and stored in memory. Then in step 2646 the format for the device is entered via keypad, decompressed and stored in memory. Finally, in step 2648 pointers to the protocol and the key data for the device are entered via keypad, decompressed and stored in memory. The entry of the data for steps 2640–2648 can be via a telephone line or via a microphone on the remote controller rather than the keypad. Once the method of FIG. 32 has been performed, then codes for controlling an appliance can be generated by the remote controller of FIG. 29 in the manner described in FIGS. 17 and 23.

There are many possible compression and decompression techniques. One form of compression would be to use Huffman coding. The effect of any compression technique is to reduce the number of key strokes for entering the data or to reduce the amount of data that needs to be transmitted, for example, over a telephone line.

The described embodiments of the invention are only considered to be preferred and illustrative of the inventive concept, the scope of the invention is not to be restricted to such embodiments. Various and numerous other arrangements may be devised by one skilled in the art without departing from the spirit and scope of this invention.

It is therefore intended by the appended claims to cover any and all such applications, modifications and embodiments within the scope of the present invention.

What is claimed is:

1. A method for generating codes for controlling appliances from a remote controller, the method comprising the steps of:

storing in ROM a protocol for generating codes for controlling an appliance, the protocol comprising a pattern fragment for a zero and a one, a zero timing, a one timing, and a carrier frequency;

storing in ROM key data corresponding to appliance command keys on the remote controller;

entering a compressed pointer for accessing a stored protocol and for accessing stored key data corresponding to appliance command keys on the remote controller;

storing in RAM the entered pointer;

decompressing the stored pointer;

accessing the protocol and the key data in ROM using the pointer; and generating a code using the pattern fragment for a zero and a one, the zero timing, the one timing, the carrier frequency, and the key data.

2. The method of claim 1 wherein the step of generating a code using the pattern fragment for a zero and a one, the zero timing, the one timing, the carrier frequency, and the key data further comprises the steps of:

generating a form for a zero and a form for a one using the pattern fragment for a zero and a one, the zero timing, and the one timing;

generating a message using the fonnat, the zero form, the one form, and the key data; and mixing the carrier frequency with the message.

3. The method of claim 1 wherein the step of entering a compressed pointer comprises the step of using a keypad.

4. The method of claim 1 wherein the step of decompressing a pointer comprises the step of using a microcomputer.

5. The method of claim 1 wherein the pattern fragment for a zero and a one comprises a pattern fragment pointer and the step of generating a code comprises a step of using the pattern fragment pointer for accessing a pattern fragment for a zero and a one from a set of stored pattern fragments.

6. The method of claim 5 wherein the stored protocol further comprises a format for generating codes and wherein the step of generating the code using the pattern fragment for a zero and a one, the zero timing, the one timing, the carrier frequency, and the key data comprises the step of generating the codes using the format.

7. The method of claim 6 wherein the stored protocol further comprises a format pointer and the step of generating the code comprises the step of accessing a format from a set of stored formats.

8. A method for generating remote control codes which are transmitted by for controlling appliances from a remote control, the method comprising the steps of:

storing in ROM, for each of a plurality of protocol building block types, a plurality of protocol building blocks for generating remote control codes for controlling an appliance;

storing in ROM key data corresponding to appliance command keys on the remote controller;

entering a progrmming code representative of one of the protocol building blocks for each of the protocol building block types, and stored key data corresponding to appliance command keys on the remote controller;

storing in RAM a pointer to each of the protocol building blocks represented by the programming code and a pointer to the key data represented by the programming code accessing the protocol building blocks and the key data in ROM using the pointers; and generating a remote control code using the accessed protocol building blocks and key data.

9. The method of claim 8 wherein the protocol building block types includes pattern fragments and formats for generating remote control codes.

10. The method of claim 8 wherein the programming code is further representative of zero timing, one timing and carrier frequency for generating remote control codes.

11. The method of claim 8 wherein the programming code is a compressed code.

12. A remote control for tramitting remote control codes for controlling appliances, the remote control comprising:

a ROM storing, (a) for each of a plurality of protocol building block types, a plurality of protocol building blocks for generating remote control codes for controlling an appliance and (b) sets of key data corresponding to appliance command keys on the remote control;

means for receiving a programming code representative of (a) one of the protocol building blocks for each of the protocol building block types and (b) key data corresponding to appliance command keys on the remote controller a RAM storing a pointer to each of the protocol building blocks represented by the programming code and a pointer to the key data represented by the programming code; and means for generating a remote control code using the protocol building blocks and the key data in ROM using the pointers in RAM.

13. The remote control of claim 12 wherein the protocol building block types includes pattern fragments and formats for generating remote control codes.

14. The remote control of claim 12 wherein the programming code is further representative of zero timing, one timing and carrier frequency for generating remote control codes.

15. The remote control of claim 12 wherein the programming code is a compressed code.

* * * * *

UNITED STATES PATENT AND TRADEMARK OFFICE

CERTIFICATE OF CORRECTION

PATENT NO. : 6,204,796 B1 
DATED : March 20, 2001
INVENTOR(S) : Philip W. Chan, Yee Kong Ng and Kwong Sang Sin It is certified that error appears in the above-identified patent and that said Letters Patent is hereby corrected as shown below:

Column 19,
Line 54, replace “fonnat” with -- format --.

Column 20,
Line 10, after “transmitted” delete “by”.
Line 19, replace “progrmming” with -- programming --.
Line 38, replace “tramitting” with -- transmitting --.

Signed and Sealed this

Twenty-third Day of July, 2002

*Attest:*

*Attesting Officer*

JAMES E. ROGAN
*Director of the United States Patent and Trademark Office*